US006047253A

United States Patent [19]

Nishiguchi et al.

[11] Patent Number: 6,047,253

[45] **Date of Patent: *Apr. 4, 2000**

[54] METHOD AND APPARATUS FOR ENCODING/DECODING VOICED SPEECH BASED ON PITCH INTENSITY OF INPUT SPEECH SIGNAL

[75] Inventors: Masayuki Nishiguchi, Kanagawa; Kazuyuki Iijima, Saitama; Jun Matsumoto, Kanagawa, all of Japan

[73] Assignee: Sony Corporation, Tokyo, Japan

[ * ] Notice: This patent is subject to a terminal disclaimer.

[21] Appl. No.: 08/925,182

[22] Filed: Sep. 8, 1997

[30] Foreign Application Priority Data

Sep. 20, 1996 [JP] Japan ..... 8-250663

[51] Int. Cl.[7] ..... G10L 9/14

[52] U.S. Cl. ..... 704/207; 704/228

[58] Field of Search ..... 704/219, 208, 704/220, 223, 228, 207

[56] References Cited

U.S. PATENT DOCUMENTS

| | | | |
|---|---|---|---|
| 4,058,676 | 11/1977 | Wilkes et al. | 704/220 |
| 5,060,269 | 10/1991 | Zinser | 704/220 |
| 5,138,661 | 8/1992 | Zinser et al. | 704/219 |
| 5,233,660 | 8/1993 | Chen | 704/208 |
| 5,488,704 | 1/1996 | Fujimoto | 704/219 |
| 5,630,012 | 5/1997 | Nishiguchi et al. | 704/208 |
| 5,749,065 | 5/1998 | Nishiguchi et al. | 704/219 |
| 5,752,222 | 5/1998 | Nishiguchi et al. | 704/201 |
| 5,828,996 | 10/1998 | Iijima et al. | 704/220 |
| 5,848,387 | 12/1998 | Nishiguchi et al. | 704/214 |

OTHER PUBLICATIONS

Masayuki Nishiguchi and Jun Matsumoto, "Harmonic and Noise Coding of LPC Residuals with Classified Vector Quantization," ICASSP–95, 1995 International Conference on Acoustics, Speech, and Signal Processing, 1995, May 1–12, 1995, vol. 1, pp. 484–487.

Gao Yang and H. Leich, "High–Quality Harmonic Coding at Very Low Bit Rates," ICASSP–94, 1994 IEEE International Conference on Acoustic, Speech, and Signal Processing, 1994, vol. i, pp. I–181 to I–184.

*Primary Examiner*—David R. Hudspeth
*Assistant Examiner*—Donald L. Storm
*Attorney, Agent, or Firm*—Jay H. Maioli

[57] ABSTRACT

A speech encoding method, a speech decoding method and corresponding apparatus capable of outputting non-buzzing spontaneous playback speech in a voiced portion includes a sinusoidal analysis encoding unit on the decoder side that detects the pitch of the voiced portion of the input speech signal. The pitch intensity information, which is a parameter containing the information representing not only the pitch intensity of the input speech signal but also the information representing proximity to the voiced speech or the unvoiced speech of the speech signal, is generated by a voiced/unvoiced (V/UV) discrimination unit and pitch intensity information generating circuit. The pitch intensity data is sent along with the encoded speech signal to the encoding side which then adds the noise component controlled on the basis of the pitch intensity information to the voiced portion of the encoded speech signal in a voiced speech synthesis portion and decodes and outputs the resulting signal.

12 Claims, 15 Drawing Sheets

| | 2Kbps | | 6Kbps | |
|---|---|---|---|---|
| V/UV & PITCH INTENSITY INFORMATION | 2bits / 20msec | | 2bits / 20msec | |
| LSP QUANTIZATION INDEX | 32bits / 40msec | | 48bits / 40msec | |
| VOICED (V) | PITCH DATA | 7bits / 20msec | PITCH DATA | 7bits / 20msec |
| | INDEX 15bits / 20msec | | INDEX 87bits / 20msec | |
| | SHAPE (FIRST STAGE)<br>GAIN | 5+5bits / 20msec<br>5bits / 20msec | SHAPE (FIRST STAGE)<br>GAIN<br>INDEX (SECOND STAGE) | 5+5bits / 20msec<br>5bits / 20msec<br>72bits / 20msec |
| UNVOICED (UV) | INDEX 11bits / 10msec | | INDEX 23bits / 5msec | |
| | SHAPE (FIRST STAGE)<br>GAIN | 7bits / 10msec<br>4bits / 10msec | SHAPE (FIRST STAGE)<br>GAIN<br>SHAPE (SECOND STAGE)<br>GAIN | 9bits / 5msec<br>6bits / 5msec<br>5bits / 5msec<br>3bits / 5msec |
| VOICED & UNVOICED | 40bits / 20msec<br>40bits / 20msec | | 120bits / 20msec<br>118bits / 20msec | |

FIG.5

| RESULTS OF V/UV DECISION | PITCH INTENSITY INFORMATION ProbV | CONDITIONS OF GENERATING PITCH INTENSITY INFORMATION |
|---|---|---|
| UV (unvoiced) | 0 | |
| V (Mixed Voiced-0) | 1 | $r'(1) < TH1$ |
| V (Mixed Voiced-1) | 2 | $TH1 \leqq r'(1) < TH2$ |
| V (Full Voiced) | 3 | $TH2 \leqq r'(1)$ |

FIG.6

| | Hv(z) | | Huv(z) | |
|---|---|---|---|---|
| | PREVIOUS FRAME | CURRENT FRAME | PREVIOUS FRAME | CURRENT FRAME |
| V → V | TRANSMITTED LSP | TRANSMITTED LSP | EQUAL INTERVAL LSP | EQUAL INTERVAL LSP |
| V → UV | TRANSMITTED LSP | EQUAL INTERVAL LSP | EQUAL INTERVAL LSP | TRANSMITTED LSP |
| UV → V | EQUAL INTERVAL LSP | TRANSMITTED LSP | TRANSMITTED LSP | EQUAL INTERVAL LSP |
| UV → UV | EQUAL INTERVAL LSP | EQUAL INTERVAL LSP | TRANSMITTED LSP | TRANSMITTED LSP |

FIG.8

METHOD AND APPARATUS FOR ENCODING/DECODING VOICED SPEECH BASED ON PITCH INTENSITY OF INPUT SPEECH SIGNAL

BACKGROUND OF THE INVENTION

1. Field of the Invention

This invention relates to a speech encoding method and apparatus in which an input speech signal is split on the time axis and encoded from one pre-set encoding unit to another. The invention also relates to an associated speech decoding method and apparatus.

2. Description of the Related Art

Up to now, there are known a variety of encoding methods for performing signal compression by exploiting statistic properties in the time domain and frequency domain of audio signals, inclusive of speech and acoustic signals, and human psychoacoustic properties. These encoding methods are roughly classified into encoding in the time domain, encoding in the frequency domain and analysis-synthesis encoding.

Among the techniques for high-efficiency encoding of speech signals, there are known sinusoidal analysis encoding, such as harmonic encoding or multi-band excitation (MBE) encoding, sub-band coding (SBC), linear predictive coding (LPC), discrete cosine transform (DCT), modified DCT (MDCT) and fast Fourier transform (FFT).

However, in the conventional harmonic coding for LPC residuals, the V/UV decision on the speech signals is a one-of-two type decision between V and UV, such that the reproduced sound for the voiced speech portion tends to be a buzzing sound.

For preventing this from occurring, the decoder side adds noise to the voiced speech portion in outputting the playback sound. However, with this method, the degree of addition of the noise is difficult to set because addition of excessive noise results in noisy playback speech, whereas addition of insufficient noise results in the buzzing playback speech.

SUMMARY OF THE INVENTION

It is therefore an object of the present invention to provide a speech encoding method and a speech encoding device and an associated speech decoding method and an associated speech decoding device according to which the encoder side detects the pitch intensity of the input speech signal and to generate a pitch intensity signal corresponding to the detected pitch intensity to transmit the resulting pitch intensity signal to the decoder side which then varies the degree of noise addition responsive to the transmitted pitch intensity information for producing a natural voiced playback speech.

The present invention provides a speech encoding method and apparatus for sinusoidal synthesis encoding of an input speech signal, according to which the pitch intensity in all bands of the voiced portion of the input speech signal is detected to output the pitch intensity information corresponding to the detected pitch intensity.

The present invention also provides a speech decoding method and apparatus for decoding the encoded speech signal obtained on sinusoidal analysis encoding the input speech signal, according to which a noise component is added to the sinusoidal synthesis waveform on the basis of the pitch intensity information representing the pitch intensity in all bands of the voiced portion of the input speech signal.

With the speech encoding method and apparatus and with the speech decoding method and apparatus according to the present invention, the spontaneous playback speech can be produced which can be optimally applied to, for example, a portable telephone system.

With the speech encoding method and device and with the speech decoding method and device according to the present invention, the pitch intensity of the input speech signal is detected on the encoding side and the pitch intensity information corresponding to the pitch intensity is transmitted to the decoding side which then varies the degree of noise addition depending on the pitch intensity information for producing spontaneous playback speech devoid of the buzzing feeling in the reproduced speech of the voiced portion.

BRIEF DESCRIPTION OF THE DRAWINGS

FIG. 5 is a table showing the bit rate of output data.

FIG. 6 is a table showing the results of V/UV decision and the condition in which the value of probV is set.

FIG. 8 is a table for illustrating switching of LSP interpolation depending on the V/UV state.

DESCRIPTION OF THE PREFERRED EMBODIMENTS

Figure 1:
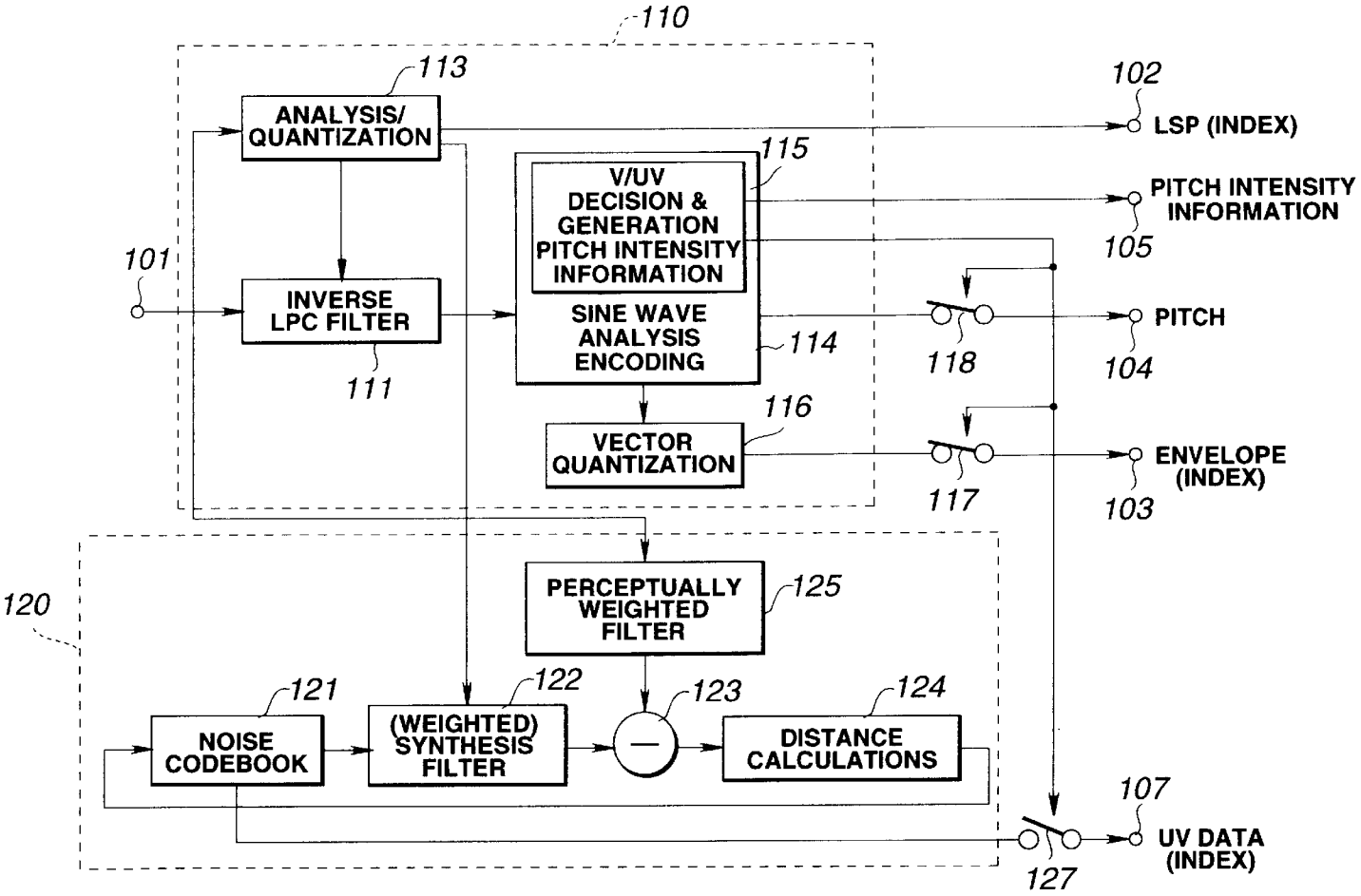
FIG. 1 is a block diagram showing the basic structure of a speech encoding device for carrying out the speech encoding method according to the present invention.

Referring to the drawings, preferred embodiments of the present invention will be explained in detail.

FIG. 1 shows the basic structure of an encoding device for carrying out the encoding method embodying the present invention.

The basic concept underlying the speech signal encoder of FIG. 1 is that the encoder has a first encoding unit 110 for finding short-term prediction residuals, such as linear prediction encoding (LPC) residuals, of the input speech signal, in order to effect sinusoidal analysis encoding, such as harmonic coding, and a second encoding unit 120 for encoding the input speech signal by waveform encoding having phase reproducibility, and that the first encoding unit 110 and the second encoding unit 120 are used for encoding the voiced (V) speech of the input signal and for encoding the unvoiced (UV) portion of the input signal, respectively.

The first encoding unit 110 employs a constitution of encoding, for example, the LPC residuals, with sinusoidal analytic encoding, such as harmonic encoding or multi-band excitation (MBE) encoding. The second encoding unit 120 employs a constitution of carrying out code excited linear prediction (CELP) using vector quantization by closed loop search of an optimum vector by closed loop search and also using, for example, an analysis by synthesis method.

In an embodiment shown in FIG. 1, the speech signal supplied to an input terminal 101 is sent to an LPC inverted filter 111 and an LPC analysis and quantization unit 113 of a first encoding unit 110. The LPC coefficients or the so-called α-parameters, obtained by an LPC analysis quantization unit 113, are sent to the LPC inverted filter 111 of the first encoding unit 110. From the LPC inverted filter 111 are taken out linear prediction residuals (LPC residuals) of the input speech signal. From the LPC analysis quantization unit 113, a quantized output of linear spectral pairs (LSPS) are taken out and sent to an output terminal 102, as later explained. The LPC residuals from the LPC inverted filter 111 are sent to a sinusoidal analytic encoding unit 114.

The sinusoidal analytic encoding unit 114 performs pitch detection and calculations of the amplitude of the spectral envelope while performing V/UV discrimination and generation of the pitch intensity information of the voiced speech (V) in the speech signal by a V/UV discrimination unit 115. The pitch intensity information includes the information specifying the pitch intensity of the speech signal but also the information specifying seemingness of the speech signal to the voiced speech or the unvoiced speech.

The spectral envelope amplitude data from the sinusoidal analytic encoding unit 114 is sent to a vector quantization unit 116. The codebook index from the vector quantization unit 116, as a vector-quantized output of the spectral envelope, is sent via a switch 117 to an output terminal 103, while an output of the sinusoidal analytic encoding unit 114 is sent via a switch 118 to an output terminal 104. A V/UV discrimination output of a V/UV discrimination and pitch intensity information generating unit 115 is sent to an output terminal 105 and, as a control signal, to the switches 117, 118. If the input speech signal is a voiced (V) sound, the index and the pitch are selected and taken out at the output terminals 103, 104, respectively. The pitch intensity information from the V/UV discrimination output of the V/UV discrimination and pitch intensity information generating unit 115 is outputted at output terminal 105.

The second encoding unit 120 of FIG. 1 has, in the present embodiment, a code excited linear prediction coding (CELP coding) configuration, and vector-quantizes the time-domain waveform using a closed loop search employing an analysis by synthesis method in which an output of a noise codebook 121 is synthesized by a weighted synthesis filter 122, the resulting weighted speech is sent to a subtractor 123, an error between the weighted speech and the speech signal supplied to the input terminal 101 and thence through a perceptually weighting filter 125 is taken out, the error thus found is sent to a distance calculation circuit 124 to effect distance calculations and a vector minimizing the error is searched by the noise codebook 121. This CELP encoding is used for encoding the unvoiced speech portion, as explained previously. The codebook index, as the UV data from the noise codebook 121, is taken out at an output terminal 107 via a switch 127 which is turned on when the pitch intensity information from the V/UV discrimination and pitch intensity information generating unit 115 specifies the unvoiced (UV) sound.

Figure 2:
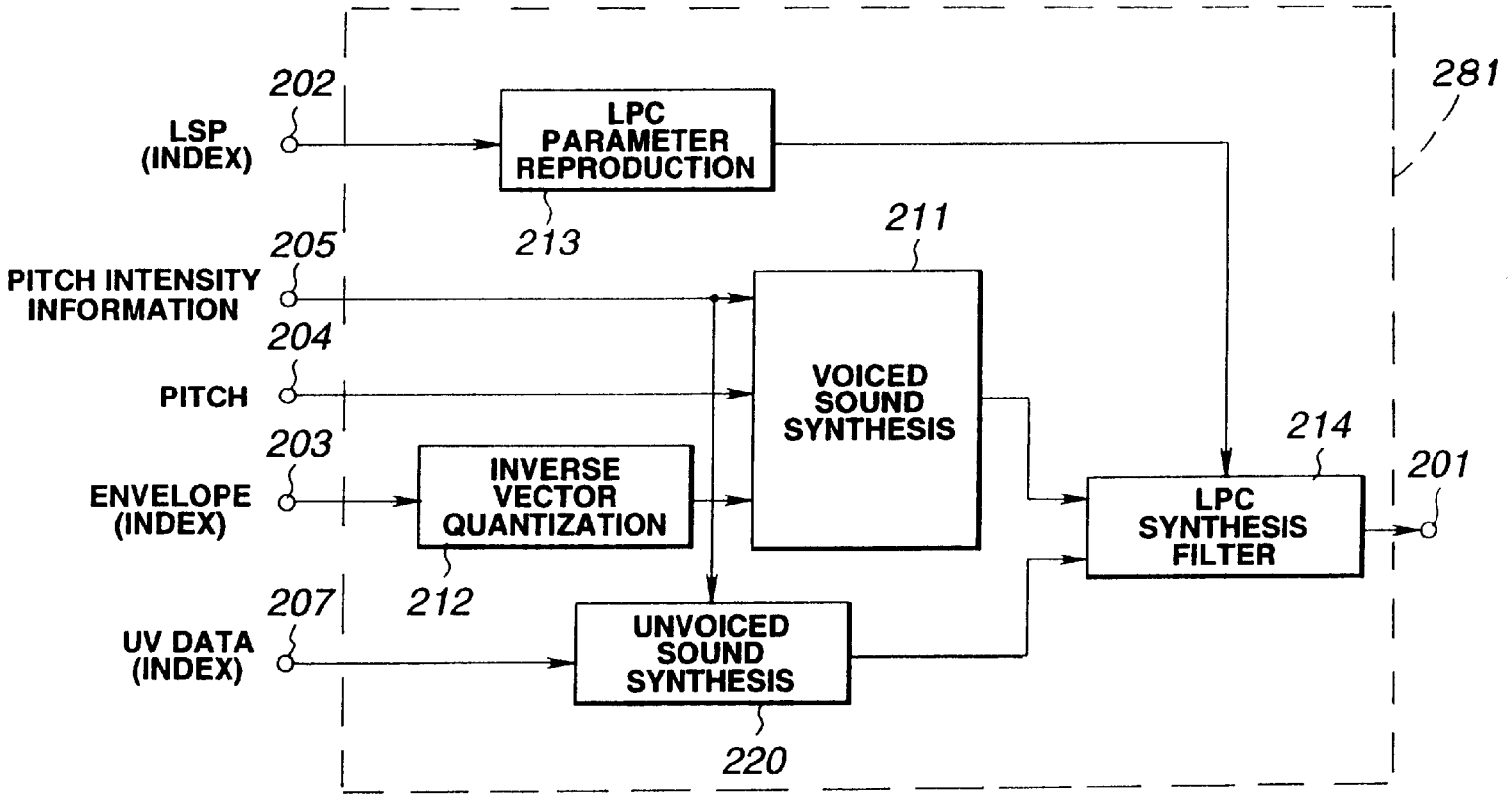
FIG. 2 is a block diagram showing the basic structure of a speech decoding device for carrying out the speech decoding method according to the present invention.

FIG. 2 is a block diagram showing the basic structure of a speech signal decoding device, as a counterpart device of the speech signal encoder of FIG. 1, for carrying out the speech decoding method according to the present invention.

Referring to FIG. 2, a codebook index as a quantization output of the linear spectral pairs (LSPs) from an output terminal 102 of FIG. 1 is supplied to an input terminal 202 of an LPC parameter reproduction circuit 213. To input terminals 203, 204 and 205 are entered outputs of the output terminals 103, 104 and 105 of FIG. 1, respectively, that is pitch intensity information data, including the V/UV decision results, and which are parameters derived from the index, pitch and the pitch intensity as envelope quantization outputs, respectively.

The index as the envelope quantization output of the input terminal 203 is sent to an inverse vector quantization unit 212 for inverse vector quantization to find a spectral envelope of the LPC residues which is sent to a voiced speech synthesizer 211. The voiced speech synthesizer 211 synthesizes the linear prediction encoding (LPC) residuals of the voiced speech portion by sinusoidal synthesis. The synthesizer 211 is fed also with the pitch and the pitch intensity information from the input terminals 204, 205. The LPC residuals of the voiced speech from the voiced speech synthesis unit 211 are sent to an LPC synthesis filter 214. The index data of the UV data from the input terminal 207 is sent to an unvoiced sound synthesis unit 220 where reference is had to the noise codebook for taking out the LPC residuals of the unvoiced portion. These LPC residuals are also sent to the LPC synthesis filter 214. In the LPC synthesis filter 214, the LPC residuals of the voiced portion and the LPC residuals of the unvoiced portion are processed by LPC synthesis. Alternatively, the LPC residuals of the voiced-portion and the LPC residuals of the unvoiced portion summed together may be processed with LPC synthesis. The LSP index data from the input terminal 202 is sent to the LPC parameter reproducing unit 213 where α-parameters of the LPC are taken out and sent to the LPC synthesis filter 214. The speech signals synthesized by the LPC synthesis filter 214 are taken out at an output terminal 201.

Figure 3:
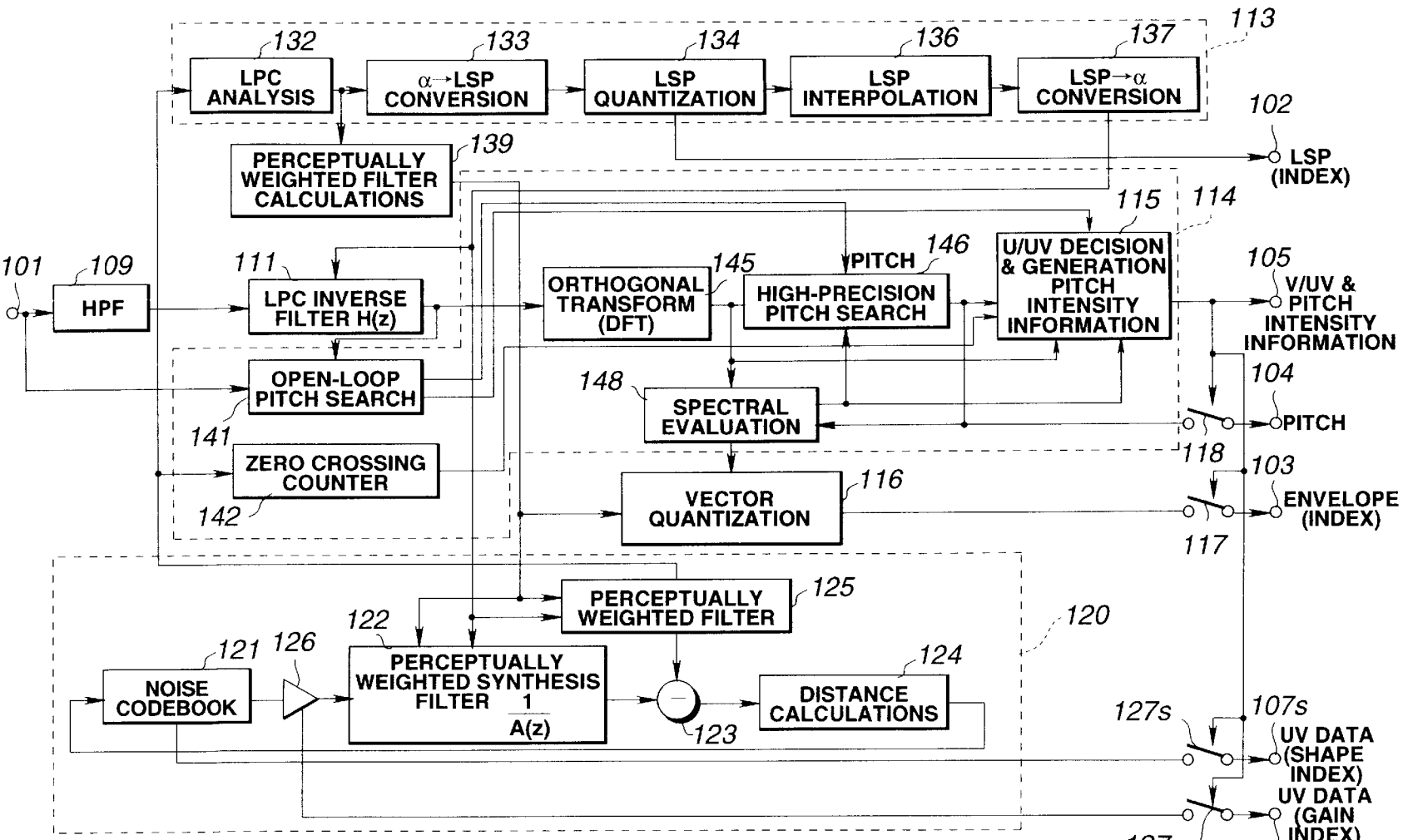
FIG. 3 is a block diagram showing a more specified structure of a speech encoding device embodying the present invention.

Referring to FIG. 3, a more detailed structure of a speech signal encoder shown in FIG. 1 is now explained. In FIG. 3, the parts or components similar to those shown in FIG. 1 are denoted by the same reference numerals.

In the speech signal encoder shown in FIG. 3, the speech signals supplied to the input terminal 101 are filtered by a high-pass filter HPF 109 for removing signals of an unneeded range and thence supplied to an LPC (linear prediction encoding) analysis circuit 132 of the LPC analysis/quantization unit 113 and to the inverted LPC filter 111.

The LPC analysis circuit 132 of the LPC analysis/quantization unit 113 applies a Hamming window, with a length of the input signal waveform on the order of 256 samples as a block, and finds a linear prediction coefficient, that is, a so-called α-parameter, by the autocorrelation method. The framing interval as a data outputting unit is set to approximately 160 samples. If the sampling frequency $f_s$ is 8 kHz, for example, a one-frame interval is 20 msec or 160 samples.

The α-parameter from the LPC analysis circuit 132 is sent to an α-LSP conversion circuit 133 for conversion into line spectrum pair (LSP) parameters. This converts the α-parameter, as found by direct type filter coefficient, into, for example, ten, that is, five pairs of the LSP parameters. This conversion is carried out by, for example, the Newton-Rhapson method. The reason the α-parameters are converted into the LSP parameters is that the LSP parameter is superior in interpolation characteristics to the α-parameters.

The LSP parameters from the α-LSP conversion circuit 133 are matrix- or vector quantized by the LSP quantizer 134. It is possible to take a frame-to-frame difference prior to vector quantization, or to collect plural frames in order to perform matrix quantization thereon. In the present case, two frames, each 20 msec long, of the LSP parameters, calculated every 20 msec, are handled together and processed with matrix quantization and vector quantization.

The quantized output of the quantizer 134, that is, the index data of the LSP quantization, are taken out at a terminal 102, while the quantized LSP vector is sent to an LSP interpolation circuit 136.

The LSP interpolation circuit 136 interpolates the LSP vectors, quantized every 20 msec or 40 msec, in order to provide an octuple rate. That is, the LSP vector is updated every 2.5 msec. The reason is that, if the residual waveform is processed with the analysis by synthesis by the harmonic encoding/decoding method, the envelope of the synthetic waveform presents an extremely smooth waveform, so that, if the LPC coefficients are changed abruptly every 20 msec, an extraneous noise is likely to be produced. That is, if the LPC coefficient is changed gradually every 2.5 msec, such extraneous noise may be prevented from occurrence.

For inverted filtering of the input speech using the interpolated LSP vectors produced every 2.5 msec, the LSP parameters are converted by an LSP to α conversion circuit 137 into α-parameters, which are filter coefficients of e.g., ten-order direct type filter. An output of the LSP to α conversion circuit 137 is sent to the LPC inverted filter circuit 111 which then performs inverse filtering for producing a smooth output using an α-parameter updated every 2.5 msec. An output of the inverse LPC filter 111 is sent to an orthogonal transform circuit 145, such as a DFT circuit, of the sinusoidal analysis encoding unit 114, such as a harmonic encoding circuit.

The α-parameter from the LPC analysis circuit 132 of the LPC analysis/quantization unit 113 is sent to a perceptual weighting filter calculating circuit 139 where data for perceptual weighting is found. These weighting data are sent to a perceptual weighting vector quantizer 116, perceptual weighting filter 125 and to the perceptual weighted synthesis filter 122 of the second encoding unit 120.

The sinusoidal analysis encoding unit 114 of the harmonic encoding circuit analyzes the output of the inverted LPC filter 111 by a method of harmonic encoding. That is, pitch detection, calculations of the amplitudes Am of the respective harmonics and voiced (V)/unvoiced (UV) discrimination, is carried out and the numbers of the amplitudes Am or the envelopes of the respective harmonics, varied with the pitch, are made constant by dimensional conversion.

In an illustrative example of the sinusoidal analysis encoding unit 114 shown in FIG. 3, commonplace harmonic encoding is used. In particular, in multi-band excitation (MBE) encoding, it is assumed in modeling that voiced portions and unvoiced portions are present in each frequency area or band at the same time point (in the same block or frame). In other harmonic encoding techniques, it is judged on the one-out-of-two basis whether the speech in one block or in one frame is voiced or unvoiced. In the following description, a given frame is judged to be UV if the totality of the bands is UV, insofar as the MBE encoding is concerned. Specific examples of the technique of the analysis synthesis method for MBE as described above may be found in JP Patent Kokai 05-265487 filed in the name of the present Assignee.

The open-loop pitch search unit 141 and the zero-crossing counter 142 of the sinusoidal analysis encoding unit 114 of FIG. 3 are fed with the input speech signal from the input terminal 101 and with the signal from the high-pass filter (HPF) 109, respectively. The orthogonal transform circuit 145 of the sinusoidal analysis encoding unit 114 is supplied with LPC residuals or linear prediction residuals from the inverted LPC filter 111. The open loop pitch search unit 141 takes the LPC residuals of the input signals to perform relatively rough open-loop pitch search. The extracted rough pitch data is sent to a fine pitch search unit 146 by closed loop search as later explained. The open loop pitch search unit 141 takes the LPC residuals of the input signal to execute rough open-loop pitch search. The extracted rough pitch data are sent to the fine pitch search unit 146 where fine pitch search is carried out by the closed loop, as explained subsequently.

Specifically, the rough pitch search by the open loop finds the P-order LPC coefficients $\alpha_p$ ($1 \leqq p \leqq P$) by, for example, the autocorrelation method. That is, the P-order LPC coefficients $\alpha_p$ ($1 \leqq p \leqq P$) are found by, for example, the autocorrelation method from $x_w(n)$ ($0 \leqq n < N$) obtained on multiplying x(n) with a Hamming window, where x(m) is an input of N samples per frame. The LPC residuals resi(n) ($0 \leqq n < N$) are obtained on inverse filtering by the following equation (1):

$$H(z) = 1 + \sum_{P=1}^{P} \alpha_P z^{-P} \tag{1}$$

Since the residuals are not correctly found in a transient portion of resi(n) ($0 \leqq n < N$), these residuals are replaced by 0. The resulting residuals are denoted as resi'(n) ($0 \leqq n < N$). The autocorrelation value $R_k$ filtered by a LPF or HPF with $f_c$ of the order of 1 kHz are calculated using the equation (2):

$$R_k = \sum_{n=0}^{(N-K-1)} resi'(n) resi'(n+k) \tag{2}$$

where $20 \leqq k < 148$, with k being an amount of shift of the samples when finding the autocorrelation value.

Instead of directly calculating the equation (2), an N number of, for example, 256, 0's may be padded in resi'(n)

for calculating the autocorrelation value Rk by carrying out FFT, power spectrum and inverse FFT in this order.

The values Rk as calculated are normalized with the 0'th peak R0 (power) of autocorrelation and sorted in the order of the decreasing magnitudes to give r'(n).

R'(0) is such that R0/R0=1 and hence $$1=r'(0)>r'(1)>r'(2)$$

where the numbers in parentheses denote the sequence.

It is noted that such k as gives the maximum value r'(1) of the normalized autocorrelation in the frame represents a pitch candidate. In the usual voiced speech domain, r'(1) is such that $0.4<r'(1)<0.9$.

Alternatively, the maximum peak after LSPing of the residuals $r'_L(1)$ or the maximum peak after HFPing of the residuals $r'_H(1)$, whichever is higher in reliability, may be selected and used, as disclosed in Japanese Patent Application 8-16433 filed by the present Assignee.

In the example disclosed in Japanese Patent Application 8-16433, r'(1) of the directly preceding frame is calculated and substituted for $r_p[2]$. Since $r_p[0]$, $r_p[1]$ and $r_p[2]$ correspond to past, present and future frames, the value of $r_p[1]$ can be used as the maximum peak r'(1) of the current frame.

From the open-loop search unit 141, the maximum value of the normalized autocorrelation r'(1), which is the maximum value of autocorrelation of the LPC residuals normalized with the power, is taken out along with the rough pitch data and thence supplied to the V/UV discrimination and pitch intensity information generating unit 115. The relative magnitude of the maximum value of normalized correlation r'(1) roughly represents the pitch intensity of the LPC residual signals.

The maximum value of this autocorrelation r'(1) is sliced with a suitable threshold value and the degree of voicedness of the speech, that is, the pitch intensity, is classed in k groups, depending on the magnitude of the sliced value. The bit patterns representing these k groups are outputted by an encoder to a decoder which then adds the noise of the variable bandwidth and variable gain to the excitation of the voiced speech generated by the sinusoidal synthesis.

The orthogonal transform circuit 145 performs orthogonal transform, such as discrete Fourier transform (DFT), for converting the LPC residuals on the time axis into spectral amplitude data on the frequency axis. An output of the orthogonal transform circuit 145 is sent to the fine pitch search unit 146 and a spectral evaluation unit 148 configured for evaluating the spectral amplitude or envelope.

The fine pitch search unit 146 is fed with relatively rough pitch data extracted by the open loop pitch search unit 141 and with frequency-domain data obtained by DFT by the orthogonal transform unit 145. The fine pitch search unit 146 swings the pitch data by ± several samples, at a rate of 0.2 to 0.5 msec, centered about the rough pitch value data, in order to arrive ultimately at the value of the fine pitch data having an optimum decimal point (floating point). The analysis by synthesis method is used as the fine search technique for selecting a pitch so that the power spectrum will be closest to the power spectrum of the original sound. The pitch data from the closed-loop fine pitch search unit 146 is sent to the spectrum evaluation unit 148 and to an output terminal 104 via a switch 118.

In the spectral evaluation unit 148, the amplitude of each of the harmonics and the spectral envelope as a set of the harmonics are evaluated based on the spectral amplitude and the pitch as an orthogonal transform output of the LPC residuals, and are sent to the fine pitch search unit 146, V/UV discrimination unit 115 and to the perceptually weighted vector quantization unit 116.

The V/UV discrimination and pitch intensity information generating unit 115 discriminates V/UV of a frame based on an output of the orthogonal transform circuit 145, an optimum pitch from the fine pitch search unit 146, spectral amplitude data from the spectral evaluation unit 148, maximum value of the normalized self-correlation r'(1) from the open loop pitch search unit 141 and the zero-crossing count value from the zero-crossing counter 142. In addition, the boundary position of the band-based V/UV discrimination for MBE may also be used as a condition for V/UV discrimination. The V/UV discrimination output of the V/UV discrimination and pitch intensity information generating unit 115 is sent as a control signal for the switches 117, 118, such that, for the voiced speech (V), the index and the pitch are selected and taken out at the output terminals 103 and 104, respectively. The pitch intensity information from the V/UV discrimination and pitch intensity information generating unit 115 is taken out at the output terminal 105.

An output unit of the spectrum evaluation unit 148 or an input unit of the vector quantization unit 116 is provided with a number of data conversion unit (a unit performing a sort of sampling rate conversion). The data number conversion unit is used for setting the amplitude data |Am| of an envelope taking into account the fact that the number of bands split on the frequency axis and the number of data differ with the pitch. That is, if the effective band is up to 3400 kHz, the effective band can be split into 8 to 63 bands depending on the pitch. The number of mMX+1 of the amplitude data |Am|, obtained from band to band, is changed in a range from 8 to 63. Thus the data number conversion unit 119 converts the amplitude data of the variable number mMx+1 to a pre-set number M of data, such as 44 data.

The amplitude data or envelope data of the pre-set number M, such as 44, from the data number conversion unit, provided at an output unit of the spectral evaluation unit 148 or at an input unit of the vector quantization unit 116, are gathered in terms of a pre-set number of data, such as 44 data, as units, and vector-quantized by the vector quantization unit 116. This weight is supplied by an output of the perceptual weighting filter calculation circuit 139. The index of the envelope from the vector quantizer 116 is taken out by the switch 117 at output terminal 103. Prior to weighted vector quantization, it is advisable to take inter-frame difference using a suitable leakage coefficient for a vector made up of a pre-set number of data.

The second encoding unit 120 is explained. The second encoding unit 120 is of the code excited linear prediction (CELP) coding structure and is used in particular for encoding the unvoiced portion of the input speech signal. In the CELP encoding configuration for the unvoiced speech portion, a noise output corresponding to LPC residuals of an unvoiced speech portion as a representative output of the noise codebook, that is, the so-called stochastic codebook 121, is sent via gain circuit 126 to the perceptually weighted synthesis filter 122. The perceptually weighted synthesis filter 122 LPC-synthesizes the input noise to send the resulting weighted unvoiced speech signal to a subtractor 123. The speech signal supplied from the input terminal 101 via high-pass filter (HPF) 109 and perceptually weighted by the perceptually weighting filter 125 is fed to the subtractor 123 where a difference or error of the perceptually weighted speech signal from the signal from the synthesis filter 122 is found. Meanwhile, the zero-input response of the perceptually weighted synthesis filter is subtracted in advance from an output of the perceptually weighting filter 125. This error is fed to a distance calculation circuit 124 for finding the distance and a representative value vector which will minimize the error is searched by the noise codebook 121. The above is the summary of the vector quantization of the time-domain waveform employing the closed-loop search in turn employing the analysis by synthesis method.

As data for the unvoiced (UV) portion from the second encoder 120 employing the CELP coding structure, the shape index of the codebook from the noise codebook 121 and the gain index of the codebook from the gain circuit 126 are taken out. The shape index, which is the UV data from the noise codebook 121, is sent via a switch 127*s* to an output terminal 107*s*, while the gain index, which is the UV data of the gain circuit 126, is sent via a switch 127*g* to an output terminal 107*g*.

These switches 127*s*, 127*g* and the switches 117, 118 are turned on and off depending on the results of V/UV decision from the V/UV discrimination unit 115. Specifically, the switches 117, 118 are turned on, if the results of V/UV discrimination of the speech signal of the frame about to be transmitted indicates voiced (V), while the switches 127*s*, 127*g* are turned on if the speech signal of the frame about to be transmitted is unvoiced (UV).

Figure 4:
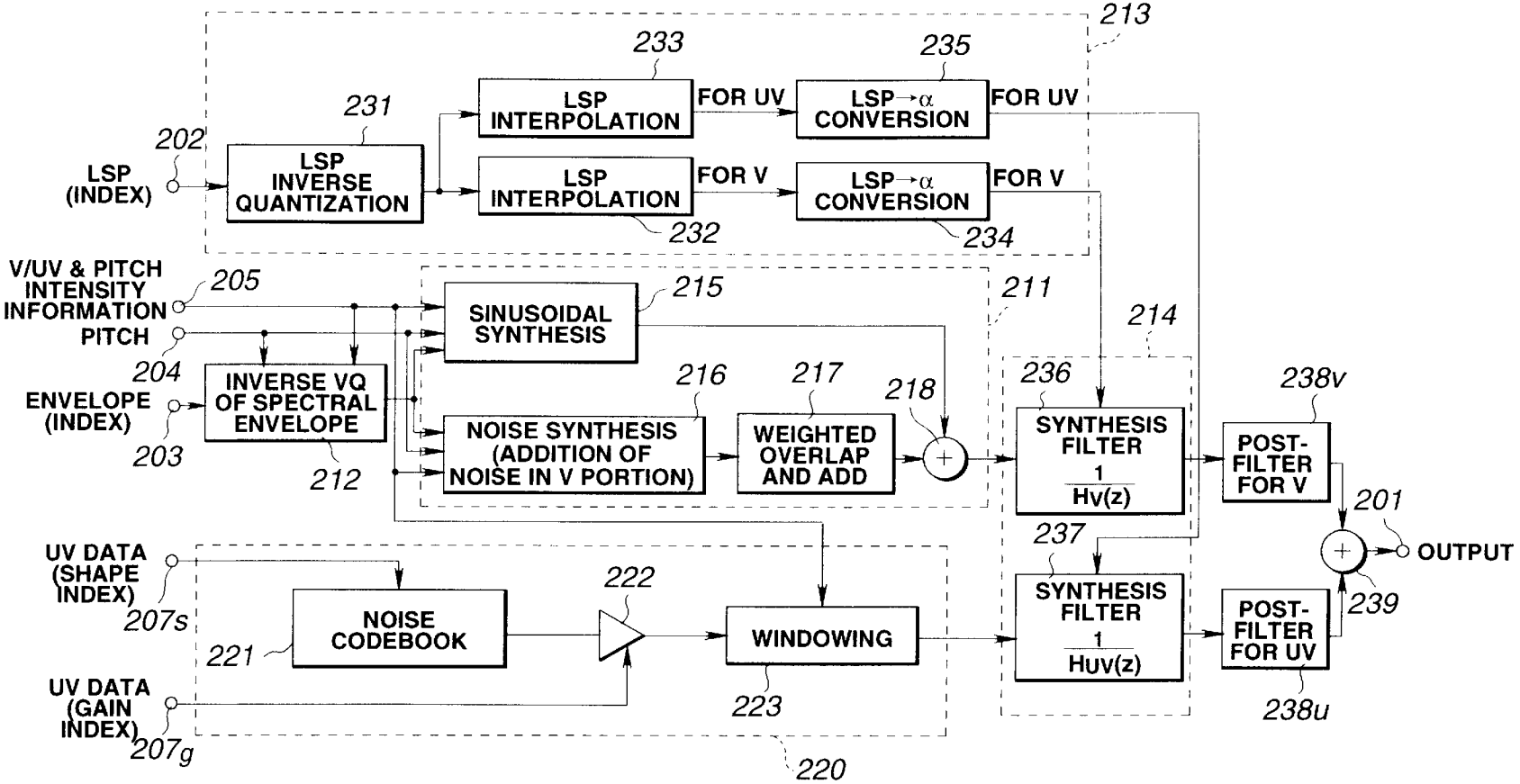
FIG. 4 is a block diagram showing a more specified structure of a speech decoding device embodying the present invention.

FIG. 4 shows a more specified structure of a speech decoding device showing an embodiment of the present invention shown in FIG. 2. In this figure, parts or components corresponding to those of FIG. 2 are indicated by the same reference numerals.

In this figure, the vector quantized output of the LSP corresponding to the output of the output terminal 102 of FIGS. 1 and 3, that is, the so-called codebook indices, are supplied to the input terminal 202.

This LSP index is sent to an inverse vector quantizer 231 of the LPC parameter regenerating unit 213 for inverse vector quantization to linear spectra pairs (LSPs) which are then sent to LSP interpolation circuits 232, 233 for LSP interpolation. The resulting data is sent to an LSP to α converting circuits 234, 235 for conversion to α parameters of the linear prediction codes (LPC) which are sent to the LPC synthesis filter 214. The LSP interpolation circuit 232 and the LSP to α converting circuit 234 are designed for the voiced (V) sound, while the LSP interpolation circuit 233 and the LSP to a converting circuit 235 are designed for the unvoiced (UV) sound. The LPC synthesis filter 214 separates the LPC synthesis filter 236 for the voiced portion from the LPC synthesis filter 237 for the unvoiced portion. That is, by independently executing LPC coefficient interpolation for the voiced and unvoiced portions, there is no adverse effect produced in the transient portion from the voiced sound to the unvoiced portion or vice versa as a result of interpolation of LSPs of totally different properties.

To the input terminal 203 of FIG. 4, there is supplied the weighted vector quantized code index data of the spectral envelope (Am) corresponding to the output of the terminal 103 on the encoder side of FIGS. 1 and 3. To the input terminals 204 and 205 are supplied pitch data from the terminal 104 of FIG. 3 and the pitch intensity information from the terminal 105 of FIGS. 1 and 3, respectively.

The vector quantized index data of the spectral envelope Am from the terminal 203 is sent to the inverse vector quantizer 212 for inverse vector quantization and for back conversion which is the reverse of the data number conversion described above. The resulting spectral envelope data is sent to a sinusoidal synthesis circuit 215 of the voiced sound synthesis unit 211.

If the inter-frame difference has been taken during encoding prior to vector quantization of the spectra components, inverse vector quantization, decoding of the inter-frame difference and data number conversion are executed in this order to produce spectral envelope data.

The sinusoidal synthesis circuit 215 is fed with the pitch from the terminal 204 and with V/UV discrimination data from the terminal 205. From the sinusoidal synthesis circuit 215, LPC residual data corresponding to an output of the LPC inverted filter 111 of FIGS. 1 and 3 are taken out and sent to the adder 218. The detailed technique for sinusoidal synthesis is disclosed in the Japanese Patent Application Nos. 4-9142 and 6-198451 filed by the present Assignee.

The envelope data from the inverse vector quantizer 212 and the pitch as well as the V/UV discrimination data from the terminals 204 and 205 are sent to a noise synthesis circuit 216 for noise addition of the voiced (V) portion. An output of the noise synthesis circuit 216 is sent via a weighted overlap add circuit 217 to an adder 218, while being sent to the sinusoidal synthesis circuit 215. Specifically, the noise taking into account the parameters derived from the encoded speech data, such as pitch, amplitudes of the spectral envelope, maximum amplitude in a frame or level of the residual signals, is added to the voiced portion of the LPC residual signals, in connection with the LPC synthesis filter input of the voiced portion, that is, excitation, in consideration that, if the excitation as an input to the LPC synthesis filter for the voiced sound is produced by sinusoidal synthesis, a buzzing sound feeling is produced in the low-pitch sound, such as male speech, while the sound quality undergoes rapid changes between the voiced (V) portion and the unvoiced (UV) portion, thus producing an extraneous feeling.

Meanwhile, the noise component sent from the noise synthesis circuit 216 via the weighted overlap-add circuit 217 to the adder 218 so as to be summed to the voiced (V) portion is not only controlled in level based on the pitch intensity information but may also have the bandwidth of the noise component added to the voiced portion controlled based on the pitch intensity information or have both the level of the added noise component and the bandwidth controlled based on the pitch intensity information. In addition, the noise component may also have the amplitudes of the harmonics controlled for the synthesized voiced speech responsive to the level of the added noise component.

An addition output of the adder 218 is sent to a synthesis filter 236 for voiced sound of the LPC synthesis filter 214 for LPC synthesis for generating the time waveform data which is then filtered by a post filter 238*v* for voiced sound so as to be sent to an adder 239.

To terminals 207*s* and 207*g* of FIG. 4, the shape index and the gain index, as UV data from the output terminals 107*s*, 107*g* of FIG. 3, are supplied, respectively, and thence supplied to an unvoiced sound synthesis unit 220. The shape index from the terminal 207*s* and the gain index from the terminal 207*g* are supplied to the noise codebook 221 and the gain circuit 222 of the unvoiced sound synthesis unit 220, respectively. The representative value output read out from the noise codebook 221 is the noise signal component corresponding to the excitation vector, that is, the LPC residuals of the unvoiced sound, and is sent to the gain circuit 222 to prove to be the amplitude of a pre-set gain which is sent to a windowing circuit 223 where it is windowed for smoothing the junction to the voiced sound portion. The windowing circuit 223 is also fed with the pitch intensity information from the input terminal 205.

An output of the windowing circuit 223 is sent to a synthesis filter 237 for the unvoiced (UV) speech of the LPC synthesis filter 214. The data sent to the synthesis filter 237 is processed with LPC synthesis to become time waveform data for the unvoiced portion. The time waveform data of the unvoiced portion is filtered by a post-filter for the unvoiced portion 238*u* before being sent to an adder 239.

In the adder 239, the time waveform signal from the post-filter for the voiced speech 238*v* and the time waveform data for the unvoiced speech portion from the post-filter 238*u* for the unvoiced speech are added to each other to give sum data which is taken out at the output terminal 201.

The above-described speech signal encoder can output data of different bit rates depending on the demanded sound quality. That is, the output data can be outputted with variable bit rates.

Specifically, the bit rate of output data can be switched between a low bit rate and a high bit rate. For example, if the low bit rate is 2 kbps and the high bit rate is 6 kbps, the output data is data of the bit rates having the following bit rates shown in FIG. 5.

It is noted that the pitch data from the output terminal 104 is outputted at all times at a bit rate of 7 bits/20 msec for the voiced speech, with the V/UV discrimination output from the output terminal 105 being at all times 1 bit/20 msec. The index for LSP quantization, outputted from the output terminal 102, is switched between 32 bits/40 msec and 48 bits/40 msec. On the other hand, the index during the voiced speech (V) outputted by the output terminal 103 is switched between 15 bits/20 msec and 87 bits/20 msec. The index for the unvoiced (UV) speech outputted from the output terminals 107*s* and 107*g* is switched between 11 bits/10 msec and 23 bits/5 msec. The output data for the voiced sound (V) is 40 bits/20 msec for 2 kbps and 120 kbps/20 msec for 6 kbps. On the other hand, the output data for the unvoiced sound (UV) is 40 bits/20 msec for 2 kbps and 118 kbps/20 msec for 6 kbps.

The indices for the LSP quantization, for voiced speech (V) and for unvoiced speech (UV) will be explained subsequently in connection with the structure of respective components.

In the speech encoder of FIG. 3, a specified example of a voiced/unvoiced (V/UV) discrimination and pitch intensity information generating unit 115 is now explained.

The V/UV discrimination unit and pitch intensity information generating circuit 115 performs V/UV discrimination of a subject frame based on an output of the orthogonal transform circuit 145, an optimum pitch from the high precision pitch search unit 146, spectral amplitude data from the spectral evaluation unit 148, a maximum normalized autocorrelation value r(p) from the open-loop pitch search unit 141 and a zero-crossing count value from the zero-crossing counter 412. The boundary position of the band-based results of V/UV decision, similar to that used for MBE, is also used as one of the conditions for the subject frame.

The condition for V/UV discrimination for the MBE, employing the results of band-based V/UV discrimination, is now explained.

The parameter or amplitude $|A_m|$ representing the magnitude of the m'th harmonics in the case of MBE may be represented by $$\therefore |A_m| = \sum_{j=a_m}^{b_m} |S(j)||E(j)| \Big/ \sum_{j=a_m}^{b_m} |E(j)|^2$$

In this equation, $|S(j)|$ is a spectrum obtained on DFTing LPC residuals, and $|E(j)|$ is the spectrum of the basic signal, specifically, a 256-point Hamming window, while $a_m$, $b_m$ are lower and upper limit values, represented by an index j, of the frequency corresponding to the m'th band corresponding in turn to the m'th harmonics. For band-based V/UV discrimination, a noise to signal ratio (NSR) is used. The NSR of the m'th band is represented by $$NSR = \frac{\sum_{j=a_m}^{b_m} \{|S(j)| - |A_m||E(j)|\}^2}{\sum_{j=a_m}^{b} |S(j)|^2}$$

If the NSR value is larger than a pre-set threshold, such as 0.3, that is if an error is larger, it may be judged that approximation of $|S(j)|$ by $|A_m|$ $|E(j)|$ in the subject band is not good, that is that the excitation signal $|E(j)|$ is not appropriate as the base. Thus the subject band is determined to be unvoiced (UV). If otherwise, it may be judged that approximation has been done fairly well and hence is determined to be voiced (V).

It is noted that the NSR of the respective bands (harmonics) represent spectral similarity from one harmonic to another. The sum of gain-weighted harmonics of the NSR is defined as $NSR_{all}$ by:

$$NSR_{all}=(\Sigma_m|A_m|NSR_m)/(\Sigma_m|A_m|)$$

The rule base used for V/UV discrimination is determined depending on whether this spectral similarity $NSR_{all}$ is larger or smaller than a certain threshold value. This threshold is herein set to $Th_{NSR}$=0.3. This rule base is concerned with the maximum value of the autocorrelation of the LPC residuals, frame power and the zero-crossing. In the case of the rule base used for $NSR_{all}<Th_{NSR}$, the frame in subject becomes V and UV if the rule is applied and if there is no applicable rule, respectively.

In the case of the rule base used for $NSR_{all} \geqq Th_{NSR}$, the frame in subject becomes UV and V if the rule is applied and if otherwise, respectively.

A specified rule is as follows:

For $NSR_{all}<TH_{NSR}$, if numZero XP<24, frmPow>340 and r'(1)>0.32, then the frame in subject is V;

For $NSR_{all} \geqq TH_{NSR}$,

If numZero XP>30, frmPow<900 and r'(1)<0.23, then the frame in subject is UV;

wherein respective variables are defined as follows:

numZeroXP: number of zero-crossings per frame frmPow: frame power r'(1): maximum value of auto-correlation The rule representing a set of specified rules such as those given above are consulted for doing V/UV discrimination.

The sequence of operations for generating the pitch intensity information probV as parameter specifying the pitch intensity of the voiced sound (V) in the speech signal in the V/UV discrimination unit and pitch intensity information generating circuit 115 is explained. FIG. 6 shows the results of V/UV decision and the condition in which the value of probV is set based on two threshold values TH1 and TH2 for classifying the degree of voicedness (that is pitch intensity) into k stages depending on the magnitude the maximum value r'(1) obtained on slicing with a suitable threshold value the maximum value r'(1) in a frame of r'(n) arrayed in the order of a decreasing magnitude on normalizing the autocorrelation value Rk with the 0'th peak R0 (power) with the amount of shifting of the sample in finding the autocorrelation k.

That is, if the results of decision on V/UV indicate completely unvoiced (UV) sound, the value of the pitch intensity information probV representing pitch intensity of the voiced speech becomes zero. At this time, noise addition to the voiced speech portion is not carried out, such that a clearer consonant is produced solely by CELP encoding.

Also, if the result of V/UV decision meets the requirement of r'(1)<TH1 (mixed voiced-0), the value of the pitch intensity information probV becomes 1. Responsive to this probV value, noise is added to the voiced portion (V).

Also, if the result of V/UV decision meets the requirement of TH1≦r'(1)<TH2 (mixed voiced-1), the value of the pitch intensity information probV becomes 2. Responsive to this value of ProbV, the noise is added to the voiced sound (V).

In addition, if the result of V/UV decision indicates fully voiced, the value of ProbV becomes 3.

In this manner, by encoding the pitch intensity information probV, as a parameter specifying the pitch intensity, with two bits, not only is the judgment on V/UV given, but also the intensity of the voiced sound can be represented in three stages if the result of V/UV decision indicates the voiced sound. Although the result of V/UV decision is conventionally given with one bit, the number of bits for pitch data is decreased from 8 to 7 and the redundant 1 bit is used for representing two bits of ProbV, as shown in FIG. 5. As specified examples of the two threshold values TH1 and TH2, TH1=0.55 and TH2=0.7.

Figure 7:
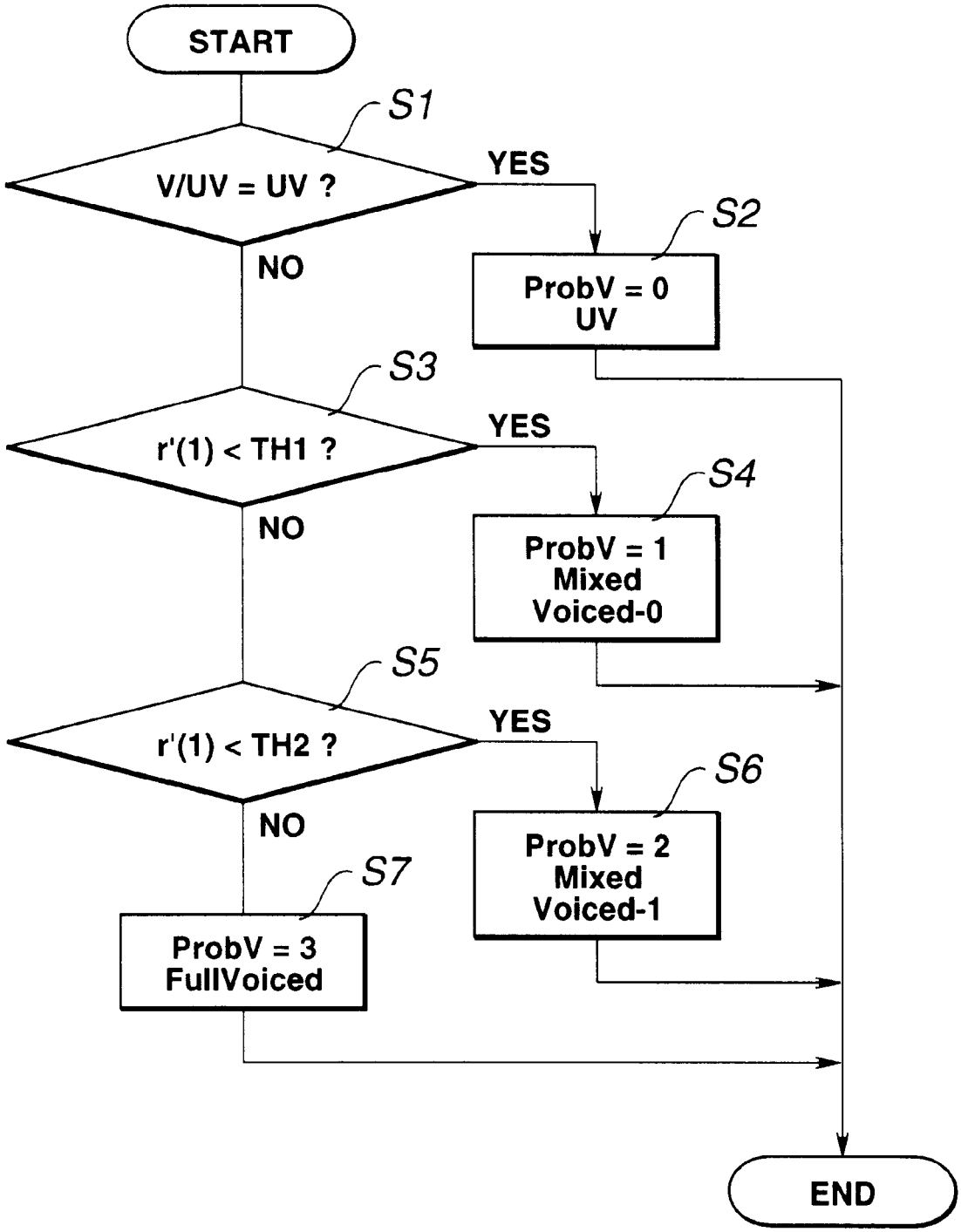
FIG. 7 is a flowchart for illustrating the sequence of operations for generating the pitch intensity information probV.
Figure 9:
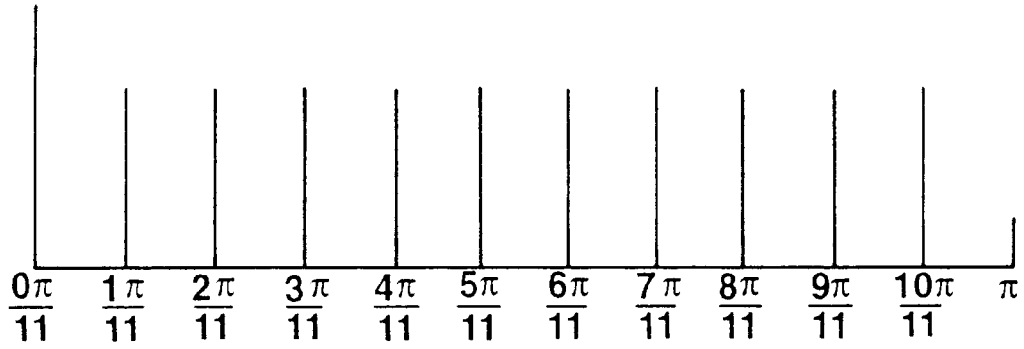
FIG. 9 illustrates 10-order linear spectral pairs (LSPs) derived from $\alpha$-parameters obtained from 10-order LPC analysis.

The sequence of operations for generating the pitch intensity information probv as parameters representing the pitch intensity is explained by referring to the flowchart of FIG. 7. It is assumed that the two threshold values TH1 and TH2 are pre-set and judgment has already been given on the V/UV of the current frame of the speech signals.

First, at step S1, V/UV decision is given on the input speech signals by the above-mentioned method. If the result of decision at step S1 is UV, the pitch intensity information probV of the voiced speech V is set to 0 and outputted at step S2. If the result of decision at step S1 is V, decision as to r'(1)<TH1 is given at step S3.

If the result of decision at step S3 is YES, the pitch intensity information probV of the voiced sound V is set to 1 and outputted at step S4. On the other hand, if the result of decision at step S3 is NO, decision as to r'(1)<TH2 is given at step S5.

If the result of decision at step S5 is YES, the pitch intensity information probV of the voiced sound V is set to 2 and outputted at step S6. Conversely, if the result of decision at step S5 is NO, the pitch intensity information probV of the voiced sound V is set to 3 and outputted at step S7.

Referring to FIG. 4 showing an illustrative structure of the speech decoding device, the manner of decoding the encoded speech signals is explained. It is assumed that the bit rate of output data is as shown in FIG. 5. The noise synthesis is done in basically the same way as in synthesis of the conventional unvoiced sound for MBE.

The more specified structure and operation of essential portions of the speech decoding device of FIG. 4 s now explained.

The LPC filter 214 is split into a synthesis filter 236 for voiced sound (V) and a synthesis filter 237 for unvoiced sound (UV), as previously explained. That is, if the synthesis filter is not split but LSP interpolation is continuously performed without V/UV distinction every 20 samples, that is, every 2.5 msecs, the LSPs of totally different properties are interpolated at V to UV or UV to V transient portions. The result is that LPC of UV and that of V are used as residuals of V and UV, respectively, such that an extraneous sound tends to be produced. For preventing such adverse effects from occurring, the LPC synthesis filter is separated into V and UV and LPC coefficient interpolation is independently performed for V and UV.

The method for coefficient interpolation of the LPC filters 236, 237 in this case is now explained. Specifically, LSP interpolation is switched depending on the V/UV state, as shown in FIG. 8.

Figure 18:
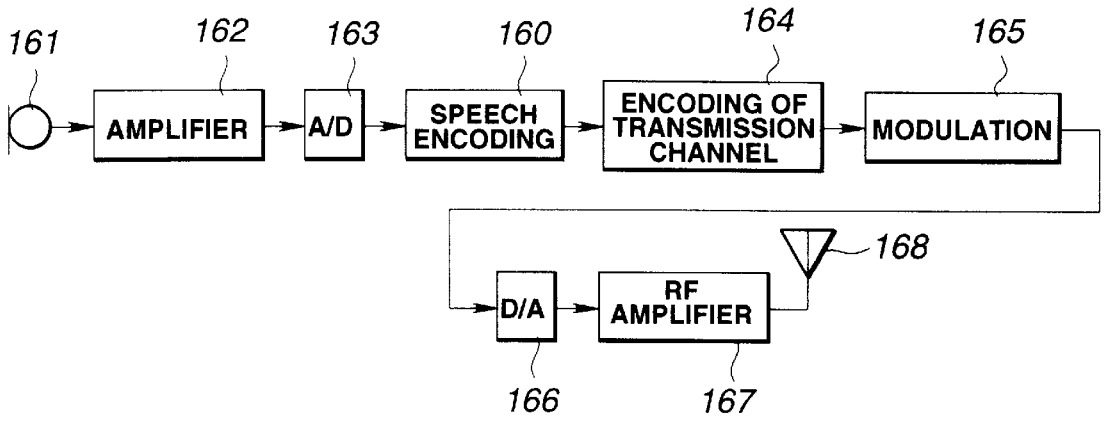
FIG. 18 is a block diagram showing the structure of the transmitting side of a portable terminal employing the speech signal encoding device embodying the present invention.

Taking an example of the 10-order LPC analysis, the equal interval LSP in FIG. 18 is such LSP corresponding to α-parameters for flat filter characteristics and the gain equal to unity, that is LSP with $\alpha_0=1$, $\alpha_1=\alpha_2=\ldots\alpha_{10}=0$, such that $LSP_1=(\pi/11)\,i$ with $0\leqq i\leqq 10$.

Figure 17:
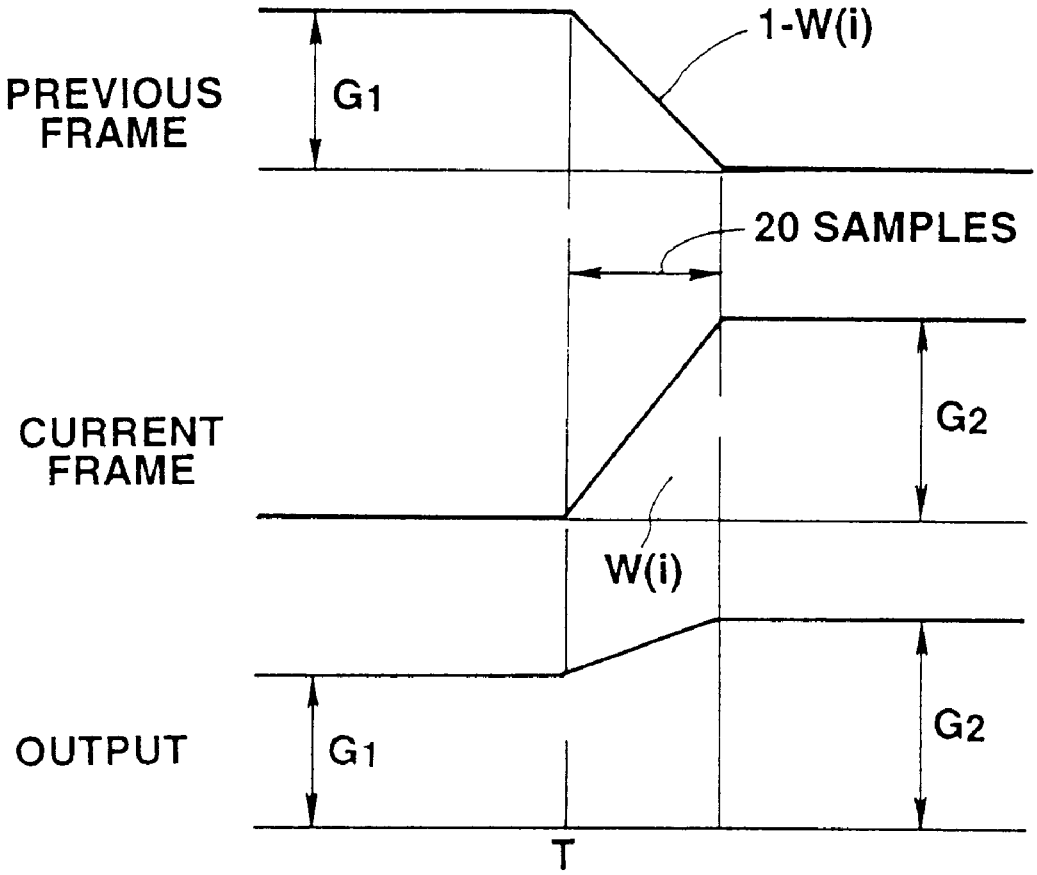
FIG. 17 illustrates the operation for merging the frame junction portions of the post-filter gain and filter coefficients.

Such 10-order LPC analysis, that is 10-order LSP, is the LSP corresponding to a completely flat spectrum, with LSPs being arrayed at equal intervals at 11 equally spaced apart positions between 0 and π, as shown in FIG. 17. In such case, the entire band gain of the synthesis filter has minimum through-characteristics at this time.

Figure 10:
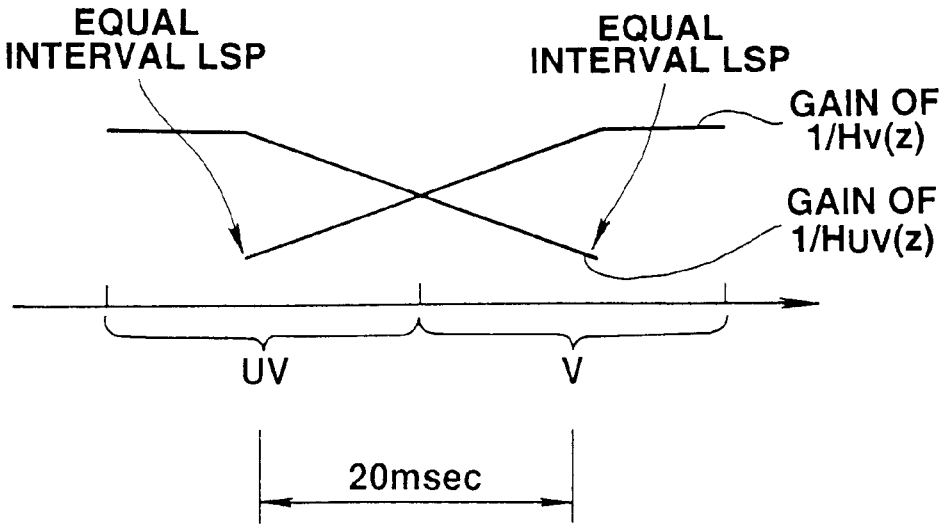
FIG. 10 illustrate gain change on transition from an unvoiced (UV) frame to a voiced (V) frame.

FIG. 10 graphically shows the manner of gain change. Specifically, FIG. 10 shows how the gain of $1/H_{uv(z)}$ and the gain of $1/H_{v(z)}$ are changed during transition from the unvoiced (UV) portion to the voiced (V) portion.

As for the unit of interpolation, it is 2.5 msec (20 samples) for the coefficient of $1/H_{v(z)}$, while it is 10 msec (80 samples) for the bit rates of 2 kbps and 5 msec (40 samples) for the bit rate of 6 kbps, respectively, for the coefficient of $1/H_{uv(z)}$. For UV, since the second encoding unit 120 performs waveform matching employing an analysis by synthesis method, interpolation with the LSPs of the neighboring V portions may be performed without performing interpolation with the equal interval LSPs. It is noted that, in the encoding of the UV portion in the second encoding portion 120, the zero-input response is set to zero by clearing the inner state of the 1/A(z) weighted synthesis filter 122 at the transient portion from V to UV.

Outputs of these LPC synthesis filters 236, 237 are sent to the respective independently provided post-filters **238*u*, 238*v***. The intensity and the frequency response of the post-filters are set to values different for V and UV for setting the intensity and the frequency response of the post-filters to different values for V and UV.

The windowing of junction portions between the V and the UV portions of the LPC residual signals, that is the excitation as an LPC synthesis filter input, is now explained. This windowing is carried out by the sinusoidal synthesis circuit 215 of the voiced speech synthesis unit 211 and by the windowing circuit 223 of the unvoiced speech synthesis unit 220 shown in FIG. 4. The method for synthesis of the V-portion of the excitation is explained in detail in JP Patent Application No.4-91422, proposed by the present Assignee, while the method for fast synthesis of the V-portion of the excitation is explained in detail in JP Patent Application No.6-198451, similarly proposed by the present Assignee. In the present illustrative embodiment, this method of fast synthesis is used for generating the excitation of the V-portion using this fast synthesis method.

Figure 11:
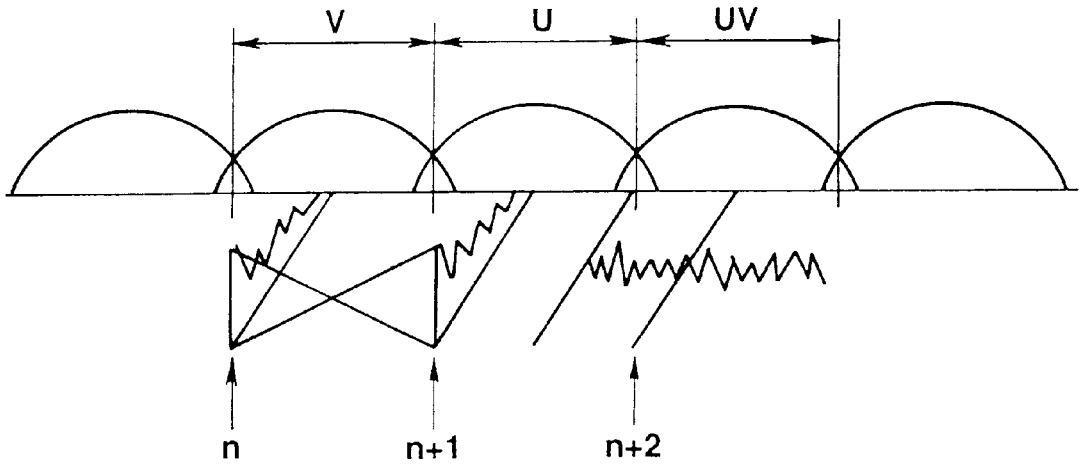
FIG. 11 illustrates the processing for interpolation of spectral components and waveform synthesized from frame to frame.

In the voiced (V) portion, in which sinusoidal synthesis is performed by interpolation using the spectrum of the neighboring frames, all waveforms between the n'th and (n+1)st frames can be produced, as shown in FIG. 11. However, for the signal portion astride the V and UV portions, such as the (n+1)st frame and the (n+2)nd frame in FIG. 11, or for the portion astride the UV portion and the V portion, the UV portion encodes and decodes only data of ±80 samples (a sum total of 160 samples is equal to one frame interval).

Figure 12:
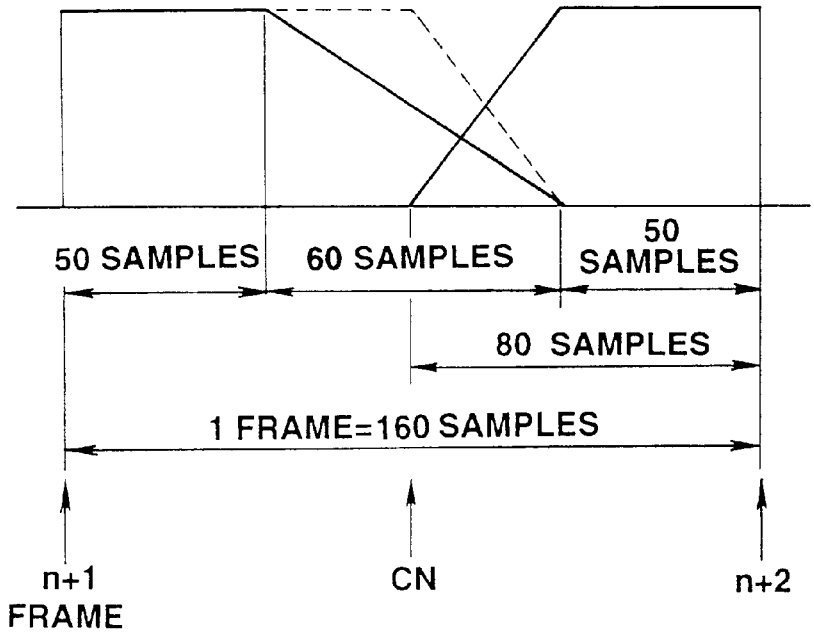
FIG. 12 illustrates overlapping at a junction between a voiced (V) frame and an unvoiced (UV) frame.

The result is that windowing is carried out beyond a center point CN between neighboring frames on the V-side, while it is carried out as far as the center point CN on the UV side, for overlapping the junction portions, as shown in FIG. 12. The reverse procedure is used for the UV to V transient portion. The windowing on the V-side may also be as shown by a broken line in FIG. 12.

The noise synthesis and the noise addition at the voiced (V) portion is explained. These operations are performed by the noise synthesis circuit 216, weighted overlap-and-add circuit 217 and by the adder 218 of FIG. 4 by adding to the voiced portion of the LPC residual signal the noise which takes into account the following parameters in connection with the excitation of the voiced portion as the LPC synthesis filter input.

That is, the above parameters may be enumerated by the pitch lag Pch, spectral amplitude Am[i] of the voiced sound, maximum spectral amplitude in a frame $A_{max}$ and the residual signal level Lev. The pitch lag Pch is the number of samples in a pitch period for a pre-set sampling frequency fs, such as fs=8 kHz, while i in the spectral amplitude Am[i] is an integer such that 0<i<I for the number of harmonics in the band of fs/2 equal to I=Pch/2.

In the following explanation, it is assumed that processing of noise addition is done at the time of synthesis of the voiced sound based on the amplitude Am[i] of the harmonics and the pitch intensity information probV.

Figure 13:
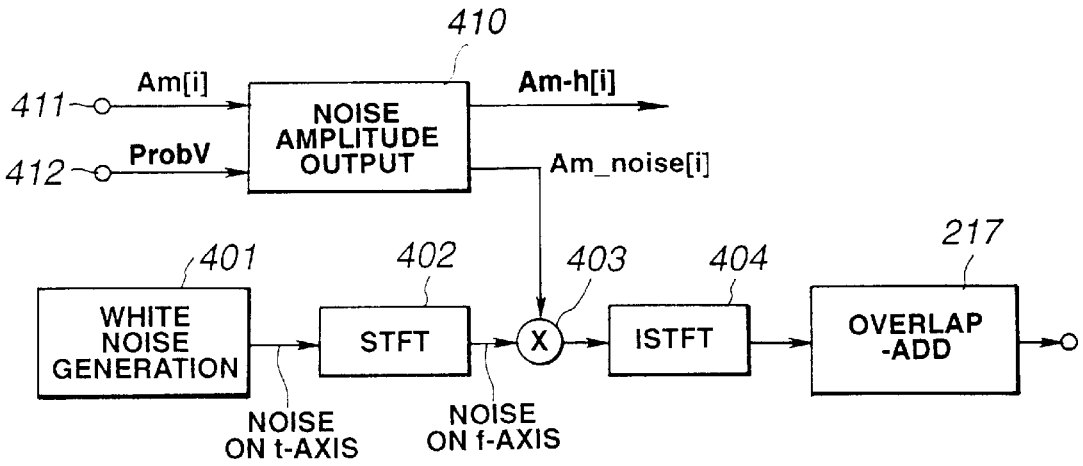
FIG. 13 illustrates noise addition at the time of voiced sound synthesis.
Figure 14:
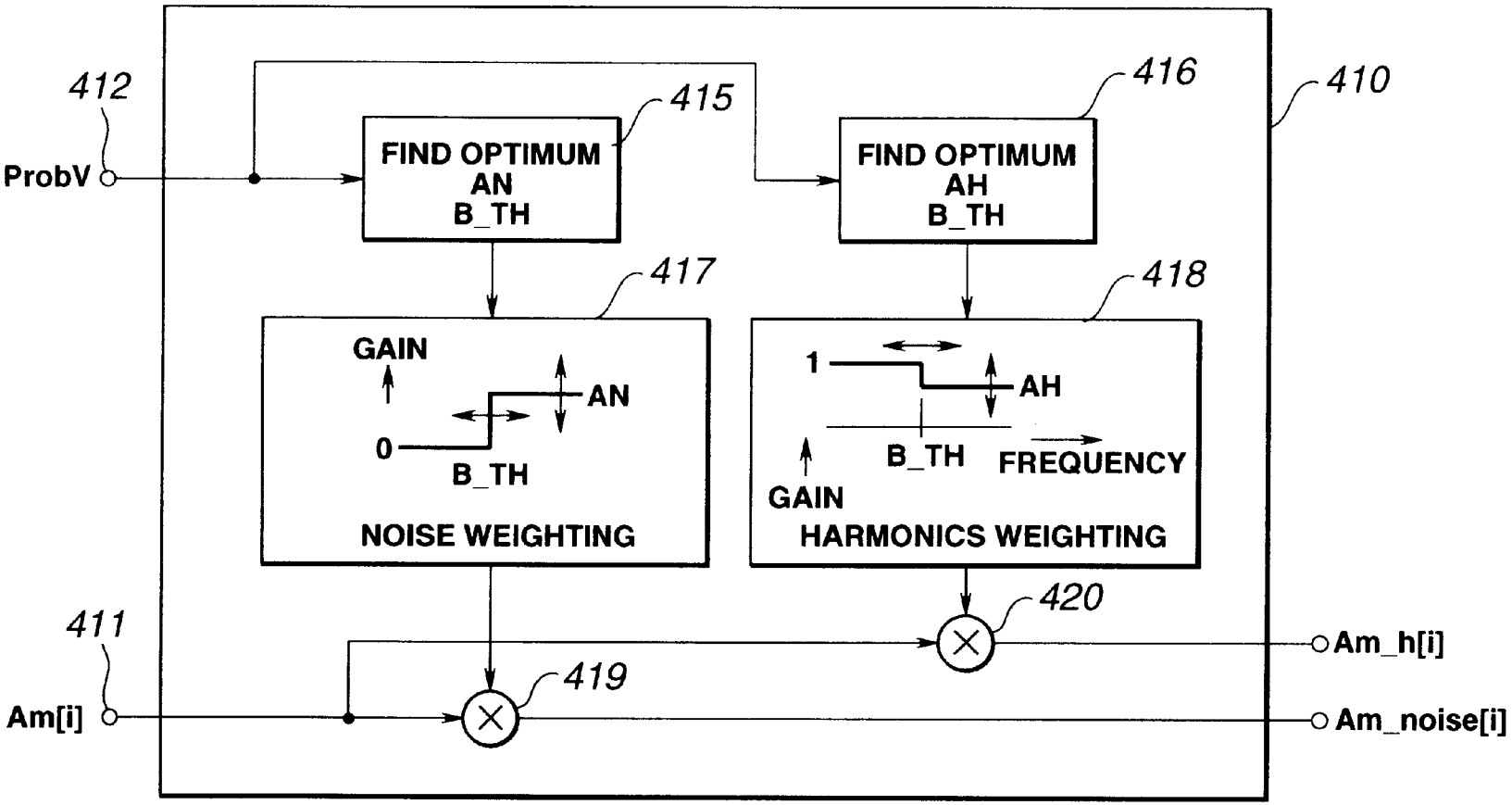
FIG. 14 illustrates an example of computing the amplitudes of the noise added at the time of synthesis of the voiced speech.

FIG. 13 shows a basic structure of the noise addition circuit 216 shown in FIG. 4 and FIG. 14 shows the basic structure of the noise amplitude harmonics amplitude control circuit 410 of FIG. 4.

Referring first to FIG. 13, the amplitudes Am[i] of harmonics and the pitch intensity information probV are entered to the input terminals 411 and 412 of the noise amplitude harmonics amplitude control circuit 410, respectively. From the noise amplitude harmonics amplitude control circuit 410 are outputted Am_h[i] and Am_noise[i] which are scaled-down versions of the amplitude Am[i] of the harmonics, as will be explained subsequently. It is noted that Am_h[i] and Am_noise[i] are sent to the voiced sound synthesis unit 211 and to the multiplier 403, respectively. A white noise generator 401 outputs the Gaussian noise which is then processed with the short-term Fourier transform (STFT) by an STFT processor 402 to produce a power spectrum of the noise on the frequency axis. The Gaussian noise is the time-domain white noise signal waveform windowed by an appropriate windowing function, such as the Hamming window, having a pre-set length, such as 256 samples. The power spectrum from the STFT processor 402 is sent for amplitude processing to a multiplier 403 so as to be multiplied with an output of the noise amplitude control circuit 410. An output of the amplifier 403 is sent to an inverse STFT (ISTFT) processor 404 where it is ISTFTed using the phase of the original white noise as the phase for conversion into a time-domain signal. An output of the ISTFT processor 404 is sent to a weighted overlap-add circuit 217.

In the embodiment of FIG. 13, the time domain noise is generated by the white noise generator 401 which is then orthogonally-transformed, such as STFTed, for producing the noise in the frequency domain. However, the frequency domain noise may also be generated directly from the noise generator. That is, orthogonal transform processing, such as STFT or FFT, can be saved by directly generating frequency domain parameters.

Specifically, random numbers in a range of ±x may be generated and handled as real and imaginary parts of the FFT spectrum. Alternatively, positive random numbers in a range of from 0 to a maximum number (max) may be generated and handled as the amplitude of the FFT spectrum, while random numbers of from −π to π may be generated and handled as the phase of the FFT spectrum.

This eliminates the FFT processor 402 of FIG. 13 to simplify the structure or reduce the processing volume.

Alternatively, the white noise generating and STFT portions of FIG. 13 can also generate random numbers which may be deemed as the real or imaginary parts or as the amplitude and phase of the white noise spectrum for processing. This eliminates STFT of FIG. 13 to reduce the processing volume.

For this noise generation, the noise amplitude information Am_noise[i] is required. However, this is not transmitted, so it is generated from the amplitude information Am[i] of the harmonics of the voiced sound. Also, for the above noise synthesis, Am_noise[i] is generated from the amplitude information Am[i], at the same time as there is generated Am_h[i], which is a scaled-down version of the amplitude information Am[i] of the voiced speech portion to which the noise is added based on the noise amplitude information Am_noise[i]. For generation of the harmonics (sinusoidal wave synthesis), Am_h[i] is used in place of Am[i].

The sequence of operations for generating Am_noise[i] and Am_h[i] is now explained.

If the number of harmonics up to 4000 Hz of the current pitch is denoted as send, send=[pitch/2]

for the sampling frequency fs of 8000 Hz. Also, AN1, AN2, AN3, AH1, AH2, AH3 and B are constants (multiplication coefficients), while TH1, TH2 and TH3 are threshold values.

The noise amplitude control circuit 410 has a basic structure shown for example in FIG. 14 and finds the noise amplitude Am_noise[i], as multiplication coefficients for the multiplier 403, based on the spectral amplitude Am[i] for the voiced sound (V) supplied via terminal 411 from the dequantizer 212 of the spectral envelope of FIG. 4 and the pitch intensity information probV supplied via input terminal 412 from the input terminal 205 of FIG. 4. The synthesized noise amplitude is controlled by this Am_noise[i]. That is, referring to FIG. 14, the pitch intensity information probV is entered to a calculation circuit 415 for optimum AN and B_TH values and a calculation circuit 416 for optimum AH and B_TH values. An output of the calculation circuit 415 for optimum AN and B_TH values is weighted by a noise weighting circuit 417, a weighted output of which is sent to a multiplier 419 for multiplication by the spectral amplitude Am[i] entered from the input terminal 411 to produce the noise amplitude Am_noise[i]. On the other hand, an output of the calculation circuit 416 for optimum AH and B_TH values is weighted by a noise weighting circuit 418, a weighted output of which is sent to a multiplier 420 for multiplication by the spectral amplitude Am[i] entered from the input terminal 411 to produce the scaled-down version of the amplitude of the harmonics Am_h[i].

Specifically, Am_h[i] and Am_noise[i], where 0≦i≦send, are determined from Am[i] and Am_noise[i], respectively, as follows:.

---

If probV = 0, that is for unvoiced sound (UV), there is no information Am[i], such that only CELP encoding is performed.

If probV = 1, that is for mixed voiced-0, Am_noise[i] is stich that

Am_noise[i] = 0 (0 ≦ i < send B_TH1)

Am_noise[i] = AN1 Am[i] (send B_TH1 ≦ i ≦ send)

while Am_[i] is such that

Am_h[i] = Am[i] (0 ≦ i < send B_TH1)

-continued

```
Am_h[i] = AH1      Am[i]      (send   B_TH1 ≦ i ≦ send)
If probV = 2 (mixed voiced-1)
Am_noise[i] is such that
Am_noise[i] = 0      (0 ≦ i < send      B_TH2)
Am_noise[i] = AN2      Am[i]      (send      B_TH2 ≦ i ≦ send)
Am_h[i] is such that
Am_h[i] = Am[i]      (0 ≦ i < send      B_TH2)
Am_h[i] = AH2      Am[i]      (send      B_TH2 ≦ i ≦ send)
For probV = 3 (full voiced),
Am_noise[i] is such that
Am_noise[i] = 0      (0 ≦ i < send      B_TH3)
Am_noise[i] = AN3      Am[i]      (send   B_TH3 ≦ i ≦ send)
Am_h[i] is such that
Am_h[i] = Am[i] (0 ≦ i < send      B_TH3)
Am_h[i] = AH3      Am[i]      (send      B_TH3 ≦ i ≦ send)
```

As a first specified example of noise synthesis and addition, it is assumed that the band of the noise added to the voiced speech portion is constant and the level (coefficient) is variable. Among illustrative examples in such case, there are:

```
probV = 1  B_TH1 = 0.5
           AN1 = 0.5
           AH1 = 0.6
probV = 2  B_TH2 = 0.5
           AN2 = 0.3
           AH2 = 0.8
probV = 3  B_TH3 = 0.7
           AN3 = 0.2
           AH3 = 1.0.
```

As a second specified example of noise synthesis and addition, it is assumed that the band of the noise added to the voiced speech portion is constant and the level (coefficient) is variable. Among illustrative examples in such case, there are:

```
probV = 1  B_TH1 = 0.6
           AN1 = 0.5
           AH1 = 0.2
probV = 2  B_TH2 = 0.8
           AN2 = 0.5
           AH2 = 0.2
probV = 3  B_TH3 = 1.0
           AN3 = 0.5 (Don't care)
           AH3 = 0 (Don't care).
```

As a third specified example of noise synthesis and addition, it is assumed that both the level (coefficient) and the band of the noise added to the voiced speech portion are variable. Among illustrative examples in such case, there are:

```
probV = 1  B_TH1 = 0.5
           AN1 = 0.5
           AH1 = 0.6
probV = 2  B_TH2 = 0.7
           AN2 = 0.4
           AH2 = 0.8
probV = 3  B_TH3 = 1.0
           AN3 = x (Don't care)
           AH3 = x (Don't care).
```

By adding the noise to the voiced speech portion in this manner, more spontaneous voiced speech can be produced.

The post-filters 238*v*, 238*u* will now be explained.

Figure 15:
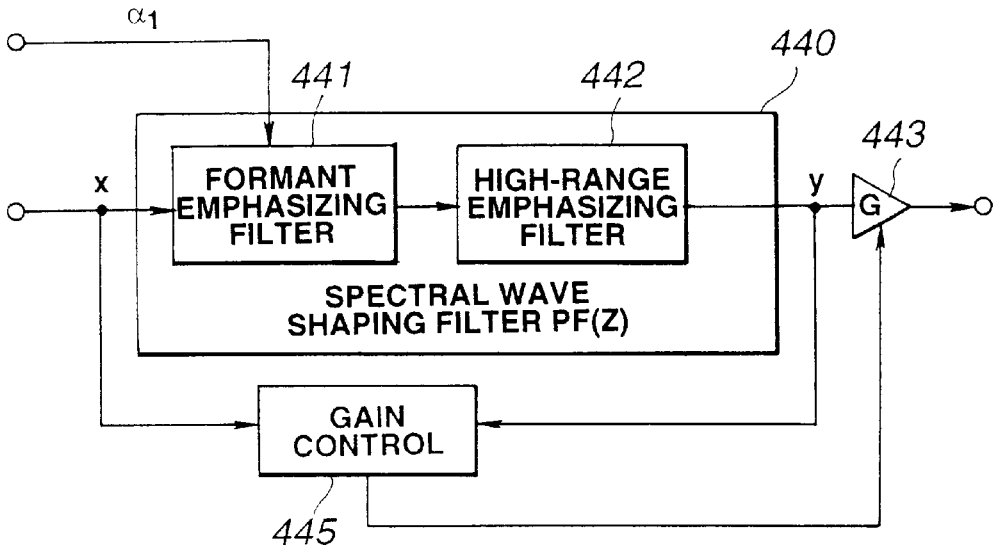
FIG. 15 illustrates an illustrative structure of a post filter.

FIG. 15 shows a post-filter that may be used as post-filters 238*u*, 238*v* in the embodiment of FIG. 4. A spectrum shaping filter 440, as an essential portion of the post-filter, is made up of a formant emphasizing filter 441 and a high-range emphasizing filter 442. An output of the spectrum shaping filter 440 is sent to a gain adjustment circuit 443 adapted for correcting gain changes caused by spectrum shaping. The gain adjustment circuit 443 has its gain G determined by a gain control circuit 445 by comparing an input x to an output y of the spectrum shaping filter 440 for calculating gain changes for calculating correction values.

If the coefficients of the denominators Hv(z) and Huv(z) of the LPC synthesis filter, that is α-parameters, are expressed as $\alpha_i$, the characteristics PF(z) of the spectrum shaping filter 440 may be expressed by:

$$PF(z) = \frac{\sum_{i=0}^{P} \alpha_i \beta^i z^{-i}}{\sum_{i=0}^{P} \alpha_i \gamma^i z^i}(1 - kz^{-1})$$

The fractional portion of this equation represents characteristics of the formant emphasizing filter, while the portion $(1-kz^1)$ represents characteristics of a high-range emphasizing filter. β, γ and k are constants, such that, for example, β=0.6, γ=0.8 and k=0.3.

The gain of the gain adjustment circuit 443 is given by:

$$G = \sqrt{\frac{\sum_{i=0}^{159} x^2(i)}{\sum_{i=0}^{159} y^2(i)}}$$

In the above equation, x(i) and y(i) represent an input and an output of the spectrum shaping filter 440, respectively.

Figure 16:
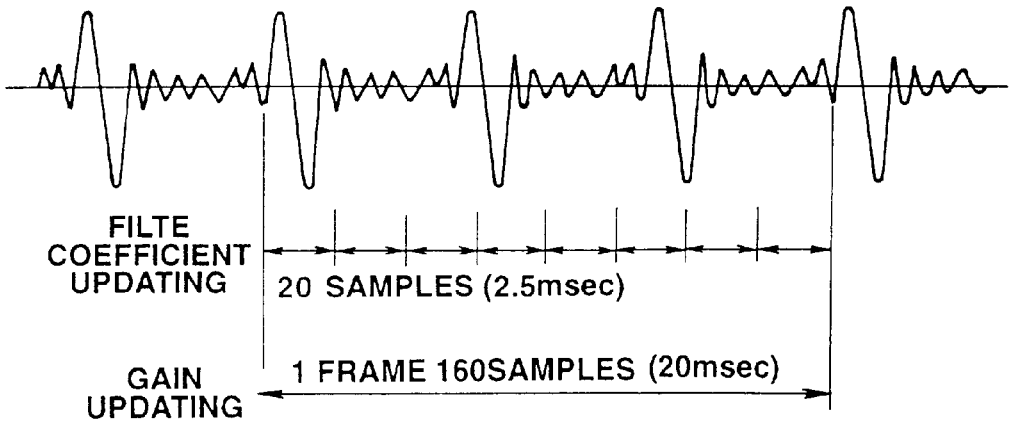
FIG. 16 illustrates the filter coefficient updating period the gain updating period of a post-filter.

It is noted that, as shown in FIG. 16, while the coefficient updating period of the spectrum shaping filter 440 is 20 samples or 2.5 msec, as is the updating period for the α-parameter which is the coefficient of the LPC synthesis filter, the updating period of the gain G of the gain adjustment circuit 443 is 160 samples or 20 msec.

By setting the coefficient updating period of the spectrum shaping filter 443 so as to be longer than that of the coefficient of the spectrum shaping filter 440 as the post-filter, it becomes possible to prevent adverse effects otherwise caused by gain adjustment fluctuations.

That is, in a generic post filter, the coefficient updating period of the spectrum shaping filter is set so as to be equal to the gain updating period and, if the gain updating period is selected to be 20 samples and 2.5 msec, variations in the gain values are caused even in one pitch period, thus possibly producing the click noise, as shown in FIG. 16. In the present embodiment, by setting the gain switching period so as to be longer, for example, so as to be equal to one frame or 160 samples or 20 msec, abrupt gain value changes may be prohibited from occurring. Conversely, if the updating period of the spectrum shaping filter coefficients is 160 samples or 20 msec, no smooth changes in filter characteristics can be produced, thus producing adverse effects in the synthesized waveform. However, by setting the filter coefficient updating period to shorter values of 20 samples or 2.5 msec, it becomes possible to realize more effective post-filtering.

By way of gain junction processing between neighboring frames, the filter coefficient and the gain of the previous frame and those of the current frame are multiplied by triangular windows of $W(i)=i/20$ $(0 \leqq i \leqq 20)$ and $1-W(i)$ where $0 \leqq i \leqq 20$ for fade-in and fade-out and the resulting products are summed together, as shown in FIG. 17. That is, FIG. 17 shows how the gain $G_1$ of the previous frame merges to the gain $G_2$ of the current frame. Specifically, the proportion of using the gain and the filter coefficients of the previous frame is decreased gradually, while that of using the gain and the filter coefficients of the current filter is increased gradually. The inner states of the filter for the current frame and that for the previous frame at a time point T of FIG. 17 are started from the same states, that is from the final states of the previous frame.

The above-described signal encoding and signal decoding device may be used as a speech codebook employed in, for example, a portable communication terminal or a portable telephone set shown in FIGS. 26 and 27.

FIG. 18 shows a transmitting side of a portable terminal employing a speech encoding unit 160 configured as shown in FIGS. 1 and 3. The speech signals collected by a microphone 161 of FIG. 18 are amplified by an amplifier 162 and converted by an analog/digital (A/D) converter 163 into digital signals which are sent to the speech encoding unit 160 configured as shown in FIGS. 1 and 3. The digital signals from the A/D converter 163 are supplied to the input terminal 101. The speech encoding unit 160 performs encoding as explained in connection with FIGS. 1 and 3. Output signals of output terminals of FIGS. 1 and 2 are sent as output signals of the speech encoding unit 160 to a transmission channel encoding unit 164 which then performs channel coding on the supplied signals. Output signals of the transmission channel encoding unit 164 are sent to a modulation circuit 165 for modulation and thence supplied to an antenna 168 via a digital/analog (D/A) converter 166 and an RF amplifier 167.

Figure 19:
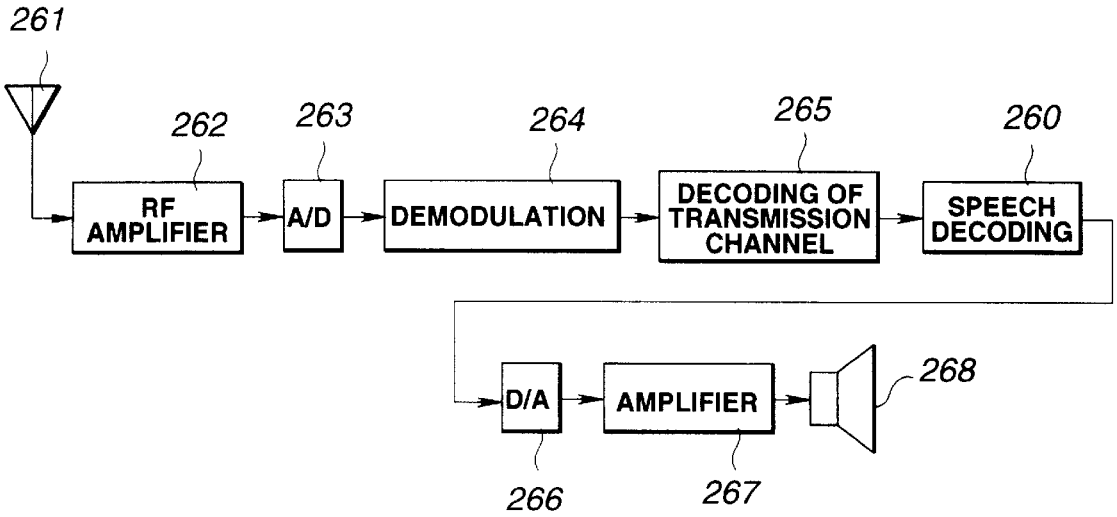
FIG. 19 is a block diagram showing the structure of the receiving side of a portable terminal employing the speech signal decoding device embodying the present invention.

FIG. 19 shows a reception side of the portable terminal employing a speech decoding unit 260 configured as shown in FIGS. 2 and 4. The speech signals received by the antenna 261 of FIG. 19 are amplified by an RF amplifier 262 and sent via an analog/digital (A/D) converter 263 to a demodulation circuit 264, from which demodulated signals are sent to a transmission channel decoding unit 265. An output signal of the decoding unit 265 is supplied to a speech decoding unit 260 configured as shown in FIGS. 2 and 4. The speech decoding unit 260 decodes the signals in a manner as explained in connection with FIGS. 2 and 4. An output signal at an output terminal 201 of FIGS. 2 and 4 is sent as a signal of the speech decoding unit 260 to a digital/analog (D/A) converter 266. An analog speech signal from the D/A converter 266 is sent to a speaker 268.

The present invention is not limited to the above-described embodiments. Although the structure of the speech analysis side (encoding side) of FIGS. 1 and 3 or that of the speech synthesis side (decoder side) of FIGS. 2 and 4 is described as hardware, it may be implemented by a software program using a digital signal processor (DSP). The post filters 238*v*, 238*u* or the synthesis filters 236, 237 on the decoder side need not be split into those for voiced sound and those for unvoiced sound, but a common post filter or LPC synthesis filter for voiced and unvoiced sound may also be used. It should also be noted that the scope of the present invention is applied not only to the transmission or recording and/or reproduction but also to a variety of other fields such as pitch or speed conversion, speech synthesis by rule or noise suppression.

What is claimed is:

1. A speech encoding method for sinusoidal analysis encoding of an input speech signal, comprising the steps of:

deciding whether the input speech signal is voiced or unvoiced;

detecting a pitch intensity in all bands of a voiced speech portion of the input speech signal based on the results of the step of deciding whether the input speech signal is voiced or unvoiced; and outputting pitch intensity information as a parameter corresponding to the pitch intensity detected in the step of detecting the pitch intensity, wherein the pitch intensity information is used in decoding an encoded speech signal coded from the input speech signal.

2. The method as claimed in claim 1, wherein, based on the results of the step of deciding whether the input speech signal is voiced or unvoiced, speech signals are encoded by sinusoidal analytic encoding and are outputted with the pitch intensity information for a voiced portion of the input speech signal, and speech signals are encoded by code excitation linear predictive coding and are outputted for an unvoiced speech portion of the input speech signal.

3. The method as claimed in claim 1 wherein the pitch intensity is detected only on a portion of the input speech signal decided to be voiced based on the results of the step of deciding whether the input speech signal is voiced or unvoiced.

4. A speech encoding apparatus for sinusoidal analysis encoding of an input speech signal, comprising:

means for deciding whether the input speech signal is voiced or unvoiced;

means for detecting a pitch intensity in all bands of a voiced speech portion of the input speech signal based on an output of the means for deciding; and means for outputting pitch intensity information as a parameter corresponding to the pitch intensity detected by the means for detecting, wherein the pitch intensity information is used in decoding an encoded speech signal coded from the input speech signal.

5. A method for decoding an encoded speech signal obtained by sinusoidal analytic encoding of an input speech signal, comprising the steps of:

deciding whether the input speech signal is voiced or unvoiced; and adding a noise component to a sinusoidal synthesis waveform based on pitch intensity information as a parameter of pitch intensity detected in all bands of a voiced speech portion of the input speech signal on the basis of results of the step of deciding whether the input speech signal is voiced or unvoiced.

6. The speech decoding method as claimed in claim 5, wherein a level of the noise component added to the sinusoidal synthesis waveform is controlled in response to the pitch intensity information.

7. The speech decoding method as claimed in claim 5, wherein a bandwidth of the noise component added to the sinusoidal synthesis waveform is controlled in response to the pitch intensity information.

8. The speech decoding method as claimed in claim 5, wherein a level and a bandwidth of the noise component added to the sinusoidal synthesis waveform are controlled in response to the pitch intensity information.

9. The speech decoding method as claimed in claim 5, wherein amplitudes of respective harmonics of the sinusoidally synthesized voiced speech are controlled in response to a level of the noise components added to the sinusoidal synthesis waveform in the step of adding the noise component.

10. The speech decoding method as claimed in claim 5, wherein an unvoiced portion of the encoded speech signal is decoded by a code excitation linear predictive decoding method.

11. The speech decoding method as claimed in claim 5, wherein a portion of the encoded speech signal decided to be voiced is decoded by sinusoidal synthesis decoding, and a portion of the encoded speech signal decided to be unvoiced is decoded by code excitation linear predictive decoding.

12. A speech decoding apparatus for decoding encoded speech signals obtained by sinusoidal synthesis encoding of an input speech signal, the apparatus comprising:

means for controlling a level and a bandwidth of a noise component added to an encoded sinusoidal synthesis waveform based on pitch intensity information provided thereto as a parameter of pitch intensity detected in all bands of a voiced speech portion of the input speech signal;

means for performing sinusoidal synthesis decoding on a portion of the input speech signal found to be voiced based on voiced/unvoiced information provided thereto; and means for performing coded excitation linear predictive decoding on a portion of the input speech signal judged to be unvoiced.

* * * * *